US008616699B2

(12) United States Patent
Mistyurik et al.

(10) Patent No.: US 8,616,699 B2
(45) Date of Patent: Dec. 31, 2013

(54) HAND-HELD PORTABLE PRINTER

(75) Inventors: John D. Mistyurik, Troy, OH (US); James A. Makley, Springboro, OH (US); Clyde N. Tharp, Dayton, OH (US)

(73) Assignee: Avery Dennison Corporation, Pasadena, CA (US)

( * ) Notice: Subject to any disclaimer, the term of this patent is extended or adjusted under 35 U.S.C. 154(b) by 155 days.

(21) Appl. No.: 13/167,838

(22) Filed: Jun. 24, 2011

(65) Prior Publication Data

US 2012/0081492 A1 Apr. 5, 2012

Related U.S. Application Data

(60) Provisional application No. 61/358,123, filed on Jun. 24, 2010.

(51) Int. Cl.
*B41J 3/36* (2006.01)

(52) U.S. Cl.
USPC ..... 347/109

(58) Field of Classification Search
None
See application file for complete search history.

(56) References Cited

U.S. PATENT DOCUMENTS

| | | | | |
|---|---|---|---|---|
| 4,745,288 | A | 5/1988 | Hurley et al. | |
| 5,009,739 | A * | 4/1991 | Goodwin et al. | 156/384 |
| 5,015,324 | A | 5/1991 | Goodwin et al. | |
| 5,107,100 | A | 4/1992 | Shepard et al. | |
| 5,227,643 | A | 7/1993 | Craig | |
| 5,229,587 | A | 7/1993 | Kimura et al. | |
| 5,239,622 | A | 8/1993 | Best | |
| 5,262,804 | A | 11/1993 | Petigrew et al. | |
| 5,287,434 | A | 2/1994 | Bain | |
| 5,345,091 | A | 9/1994 | Craig | |
| 5,400,058 | A | 3/1995 | Helmbold | |
| 5,402,528 | A | 3/1995 | Christopher | |
| 5,467,433 | A | 11/1995 | Lamprecht | |
| 5,483,624 | A | 1/1996 | Christopher | |
| 5,486,259 | A | 1/1996 | Goodwin et al. | |
| 5,487,337 | A | 1/1996 | Uland | |
| 5,497,450 | A | 3/1996 | Helmbold | |
| 5,506,613 | A | 4/1996 | Helmbold | |
| 5,524,993 | A | 6/1996 | Durst | |
| 5,525,184 | A | 6/1996 | Luff et al. | |
| 5,533,176 | A | 7/1996 | Best | |

(Continued)

FOREIGN PATENT DOCUMENTS

| | | |
|---|---|---|
| GB | 2423735 | 9/2006 |
| JP | 58203067 | 11/1983 |
| JP | 2001127410 | 5/2001 |

OTHER PUBLICATIONS

Written Opinion dated Nov. 9, 2011 for International Application No. PCT/US2011/041727 filed Jun. 24, 2011.

(Continued)

*Primary Examiner* — Stephen Meier
*Assistant Examiner* — Tracey McMillion
(74) *Attorney, Agent, or Firm* — Avery Dennison Corporation

(57) ABSTRACT

A hand-held labeler/printer for printing and applying labels is described. The labeler/printer has a keyboard, a display, a scanner, and a battery-containing handle. The labeler/printer is user-friendly and compact. The labeler/printer can be easily loaded with label and webs of different widths. The labeler/printer has a discharge area along its front for the carrier web. Also described are various charging cradles and controllers for the labeler/printers.

13 Claims, 24 Drawing Sheets

(56) References Cited

U.S. PATENT DOCUMENTS

| | | | |
|---|---|---|---|
| 5,544,287 | A | 8/1996 | Roth |
| 5,555,351 | A | 9/1996 | Craig |
| 5,594,838 | A | 1/1997 | Christopher |
| 5,642,666 | A | 7/1997 | Petteruti |
| 5,683,545 | A | 11/1997 | Goodwin |
| 5,698,961 | A | 12/1997 | Kutz et al. |
| 5,708,462 | A | 1/1998 | Helmbold |
| 5,745,146 | A | 4/1998 | Durst |
| 5,800,669 | A | 9/1998 | Goodwin et al. |
| 5,800,724 | A | 9/1998 | Habeger et al. |
| 5,805,779 | A | 9/1998 | Christopher |
| 5,825,995 | A | 10/1998 | Wiklof et al. |
| 5,833,800 | A | 11/1998 | Goodwin |
| 5,875,715 | A | 3/1999 | Hamisch, Jr. et al. |
| 5,900,110 | A | 5/1999 | Goodwin et al. |
| 5,906,443 | A | 5/1999 | Goodwin |
| 5,910,227 | A | 6/1999 | Mistyurik et al. |
| 5,988,249 | A | 11/1999 | Mistyurik et al. |
| 6,038,377 | A | 3/2000 | Christopher |
| 6,105,497 | A | 8/2000 | Hermann |
| 6,138,734 | A | 10/2000 | Hamisch, Jr. et al. |
| 6,158,662 | A | 12/2000 | Kahn et al. |
| 6,163,538 | A | 12/2000 | Brown |
| 6,191,382 | B1 | 2/2001 | Damikolas |
| 6,231,253 | B1 | 5/2001 | Henderson et al. |
| 6,241,407 | B1 | 6/2001 | Huggins et al. |
| 6,279,638 | B1 | 8/2001 | Goodwin et al. |
| 6,352,497 | B1 | 3/2002 | Hensley et al. |
| D458,265 | S | 6/2002 | Fitch |
| 6,428,220 | B1 | 8/2002 | Arnold |
| 6,502,754 | B1 | 1/2003 | Bhatia et al. |
| 6,562,509 | B1 | 5/2003 | Eggert |
| 6,585,434 | B2 | 7/2003 | Arnold |
| D484,906 | S | 1/2004 | Arnold et al. |
| D486,512 | S | 2/2004 | Arnold |
| 6,712,112 | B2 | 3/2004 | Goodwin |
| 6,766,842 | B1 | 7/2004 | Mistyurik et al. |
| 6,805,183 | B2 | 10/2004 | Goodwin |
| 6,965,214 | B2 | 11/2005 | Kubale |
| 7,000,666 | B2 | 2/2006 | Goodwin |
| 7,327,120 | B2 | 2/2008 | Lin |
| 7,367,372 | B2 | 5/2008 | Goodwin et al. |
| 7,456,609 | B2 | 11/2008 | Fuchs |
| 7,535,197 | B2 | 5/2009 | Huang |
| 7,541,774 | B2 | 6/2009 | Zedell et al. |
| 7,609,406 | B2 | 10/2009 | Roth et al. |
| 7,642,744 | B2 | 1/2010 | Zedell et al. |
| 2001/0000423 | A1 | 4/2001 | Fischer et al. |
| 2002/0079864 | A1 | 6/2002 | Soumi et al. |
| 2004/0221952 | A1 | 11/2004 | Hirschmann et al. |
| 2006/0032386 | A1 | 2/2006 | Goodwin et al. |
| 2006/0051150 | A1 | 3/2006 | Klein |
| 2006/0144521 | A1 | 7/2006 | Esposito et al. |
| 2006/0213620 | A1 | 9/2006 | Shimosaka |
| 2007/0209755 | A1 | 9/2007 | Smith |
| 2008/0277069 | A1 | 11/2008 | Tharp |
| 2009/0065150 | A1 | 3/2009 | Tharp |
| 2009/0109271 | A1 | 4/2009 | Studer et al. |
| 2010/0079107 | A1 | 4/2010 | Silverbrook |
| 2010/0103238 | A1* | 4/2010 | Neuhard et al. ..... 347/109 |
| 2012/0069118 | A1 | 3/2012 | Mistyurik |
| 2012/0075397 | A1 | 3/2012 | Mistyurik |
| 2012/0081492 | A1 | 4/2012 | Mistyurik |
| 2012/0081493 | A1 | 4/2012 | Mistyurik |

OTHER PUBLICATIONS

International Search Report dated Nov. 9, 2011 for International Application No. PCT/US2011/041727 filed Jun. 24, 2011.

Written Opinion dated Nov. 29, 2011 for International Application No. PCT/US2011/041752 filed Jun. 24, 2011.

International Search Report dated Nov. 29, 2011 for International Application No. PCT/US2011/041752 filed Jun. 24, 2011.

Written Opinion dated Oct. 31, 2011 for International Application No. PCT/US2011/041734 filed Jun. 24, 2011.

International Search Report dated Oct. 31, 2011 for International Application No. PCT/US2011/041734 filed Jun. 24, 2011.

Partial International Search Report dated Oct. 10, 2011 for International Application No. PCT/US2011/040386 filed Jun. 24, 2011.

U.S. Appl. No. 13/167,937, Non Final Office Action mailed Apr. 25, 2013, 9 pgs.

U.S. Appl. No. 13/167,961, Non Final Office Action mailed Jun. 18, 2013, 10 pgs.

U.S. Appl. No. 13/168,051, Non Final Office Action mailed Apr. 26, 2013, 9 pgs.

* cited by examiner

HAND-HELD PORTABLE PRINTER

CROSS-REFERENCE TO RELATED APPLICATION

The present application claims the benefit of U.S. Provisional Application No. 61/358,123 filed Jun. 24, 2010, which is incorporated herein by reference in its entirety.

FIELD OF THE INVENTION

The present subject matter relates to portable printers, portable data entry devices, labelers and/or accessories therefor.

BACKGROUND OF THE INVENTION

A wide variety of different portable printers are known in the art. Often, such printers are incorporated into hand-held labelers that can directly print one or more labels from a wound roll of blank labels carried on or in the device.

Numerous features and functions have also been incorporated in such devices. For example, optical scanners such as used for reading barcodes and the like, radio-based communication provisions, microprocessor-based computing capabilities, and sophisticated operator interfaces are now typically available in hand-held labeling devices.

However, as the functional features and capabilities of such devices have significantly increased, so too has their complexity. This can be undesirable as greater complexity generally demands sophisticated manufacturing operations which tend to increase costs. Moreover, as such devices are designed for hand-held operation; it is desirable that the devices maintain a readily manageable weight and/or size. These design goals can present formidable challenges in view of demands for increased device functionality and capabilities.

In view of these and other concerns, a desire exists for a hand-held portable labeler and/or printer that includes an array of features and functions, yet which is relatively elegant in its simplicity and operation, and further provides additional improvements over currently known hand-held labelers/printers.

SUMMARY OF THE INVENTION

This summary is provided to introduce concepts related to the present inventive subject matter. This summary is not intended to identify essential features of the claimed subject matter nor is it intended for use in determining or limiting the scope of the claimed subject matter. In any event, certain of the difficulties and drawbacks associated with previously known hand-held devices are addressed by selected embodiments of the present apparatus for a hand-held portable labeler/printer with a variety of unique features.

In accordance with one embodiment, a printer is provided that comprises a housing including a main body, a battery enclosure, and a handle extending therebetween. The main body defines a front end and an opposite rear end, a front face extending from the front end, and a rear face extending from the rear end, the front and rear faces meeting along a raised center region. The housing also defines an interior region. The printer also comprises a drive module assembly generally disposed with the interior region defined in the housing. The drive module includes provisions for advancing material for printing from a wound roll also disposed in the interior region. The printer additionally comprises a selectively movable printing module assembly secured to the housing and positionable between a closed position and an open position. The printing module generally constitutes the front face of the housing when in the closed position. The printing module includes provisions for printing on the material. The printer additionally comprises an operator interface and an electronic module assembly generally accessible along the rear face of the housing.

In another embodiment, a hand-held portable printer is provided. The printer includes: a housing having a main body and a handle extending therefrom; a rotatably driven platen roller supported in the main body of the housing; a supply roll holder that holds a supply roll of media or feedstock in the main body of the housing; and a print module including a printhead that selectively prints on the media routed between the printhead and the platen roller from the supply roll held by the supply roll holder. Suitably, the print module is attached to the upper main body of the housing such that the print module is movable between a closed operational position in which the printhead is proximate the platen roller and an open loading position in which the printhead is spaced apart from the platen roller. The printer may also include a circuit board including an electrical ground.

In another embodiment, the aforementioned printer may further include a first electrically conductive ground path extending from the printhead to the electrical ground on the circuit board, the circuit board being housed outside the movable print module, and the first electrically conductive ground path remaining unbroken regardless of the position of the print module.

In another embodiment, in accordance with any of the aforementioned printers, the circuit board may be housed within the handle of the printer.

In another embodiment, in accordance with any of the aforementioned printers, at least a portion of the first electrically conductive ground path may include a printhead mount to which the printhead is mounted.

In another embodiment, in accordance with any of the aforementioned printers, at least a portion of the first electrically conductive ground path may include a frame to which the printhead is mounted is attached.

In another embodiment, in accordance with any of the aforementioned printers, either one of the frame or the printhead mount or both may be made from an electrically conductive plastic.

In another embodiment, in accordance with any of the aforementioned printers, the frame may include a hub that engages a post about which the hub rotates when the printhead module is moved between its open and closed positions. The hub may further have a surface which is at least part of the first electrically conductive ground path.

In another embodiment, in accordance with any of the aforementioned printers, the first electrically conductive ground path may further include at least one contact which is substantially stationary with respect to the hub, the contact abutting the surface of the hub as it is rotated.

In another embodiment, in accordance with any of the aforementioned printers, the first electrically conductive ground path may further include at least one ground wire which extends from the contact to the circuit board.

In another embodiment, in accordance with any of the aforementioned printers, the first electrically conductive ground path may be provided so that it does not include any flexible portion within the print module that is bent when the print module is moved between its closed and open positions.

In another embodiment, any of the aforementioned printers may further include a trigger that is manually actuated by a user to control an operation of the printer.

In another embodiment, any of the aforementioned printers may further include a second electrically conductive ground path extending from the trigger to the electrical ground on the circuit board.

In another embodiment, in accordance with any of the aforementioned printers, the second electrically conductive ground path may include a biasing member that biases the trigger towards an unactuated state.

In another embodiment, in accordance with any of the aforementioned printers, the biasing member may be either a leaf spring or a compression spring.

In another embodiment, in accordance with any of the aforementioned printers, the electrical ground may be a ground plate and at least one end of the biasing member may directly contact the ground plate.

In another embodiment, in accordance with any of the aforementioned printers, the trigger may be made from an electrically conductive plastic.

As will be realized, the inventive subject matter may take form in other and different embodiments and its several details are capable of modifications in various respects, all without departing from the scope of the inventive subject matter. Accordingly, the drawings and description are to be regarded as illustrative and not restrictive.

DETAILED DESCRIPTION OF THE EMBODIMENTS

Generally, the present specification describes an ergonomic, user-friendly hand-held printer or labeler device with onboard optical scanning, programmable operation, and power provisions. The device is particularly adapted for use as a hand-held labeler and its embodiments are described herein as such. The printer or labeler devices include a multitude of features and functions, all of which are described in detail herein. For convenience, the devices are typically referred to herein as labelers and/or printers, although the devices are not limited to the printing of labels, but instead can be used for printing other materials, media and feedstocks or used in applications exclusive of printing such as in scanning operations.

Figure 1:
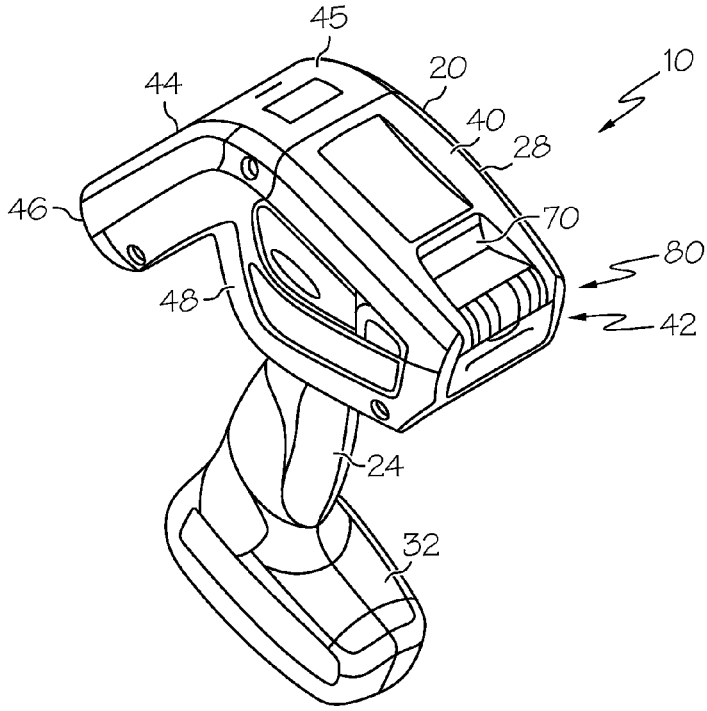
FIG. 1 is a front perspective view of an exemplary embodiment of a hand-held portable labeler/printer in accordance with aspect of the present inventive subject matter.
Figure 2:
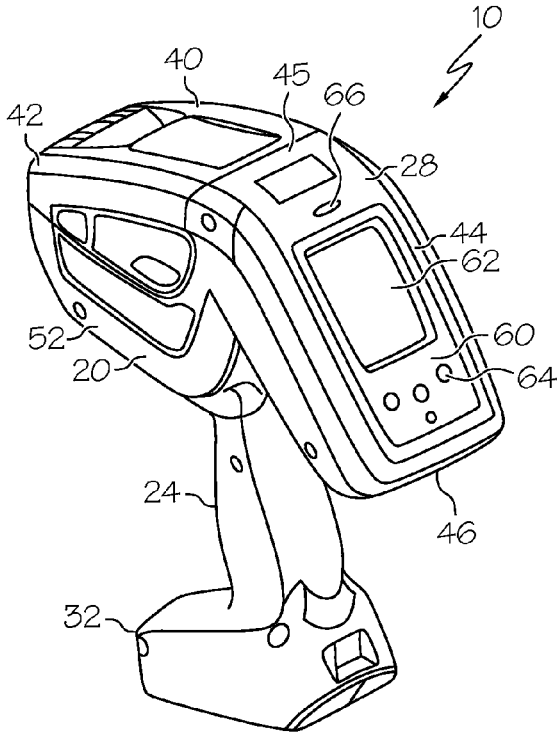
FIG. 2 is a rear perspective view of the labeler/printer illustrated in FIG. 1.

FIGS. 1 and 2 illustrate an exemplary embodiment of a labeler and/or printer 10 in accordance with aspect of the present inventive subject matter. The labeler/printer 10 comprises a housing 20 having an upper main body 28, a lower battery enclosure 32, and a handle 24 extending therebetween. The handle 24 includes a trigger or actuator (not shown), the operation of which is described in greater detail herein. The main body 28 includes a front nose end 42 and an opposite rear end 46. A sloping front face 40 extends generally upwardly and rearwardly from the front nose end 42. A sloping rear face 44 extends generally upwardly and frontwardly from the rear end 46. The front face 40 and the rear face 44 meet along a raised central region 45 of the housing 20. The housing 20 of the labeler/printer 10 further defines a first or right hand side 48 of the labeler/printer 10 extending between corresponding regions of the nose end 42, the front face 40, the rear face 44, and the rear end 46. The housing 20 also defines an oppositely directed second or left hand side 52 of the labeler/printer 10 extending between corresponding regions of the nose end 42, the front face 40, the rear face 44, and the rear end 46. The labeler/printer 10 also comprises an operator interface 60 generally accessible along the rear face 44 of the main body 28. The operator interface 60 includes a monitor 62, one or more selection buttons 64, and one or more optical indicators 66. The labeler/printer 10 also comprises a scanner 70 and a print engine 80 generally enclosed within the main body 28 of the housing 20, however accessible along the front face 40 of the main body 28. Each of these components and additional details of the labeler/printer 10 are described herein.

Figures 3, 3A:
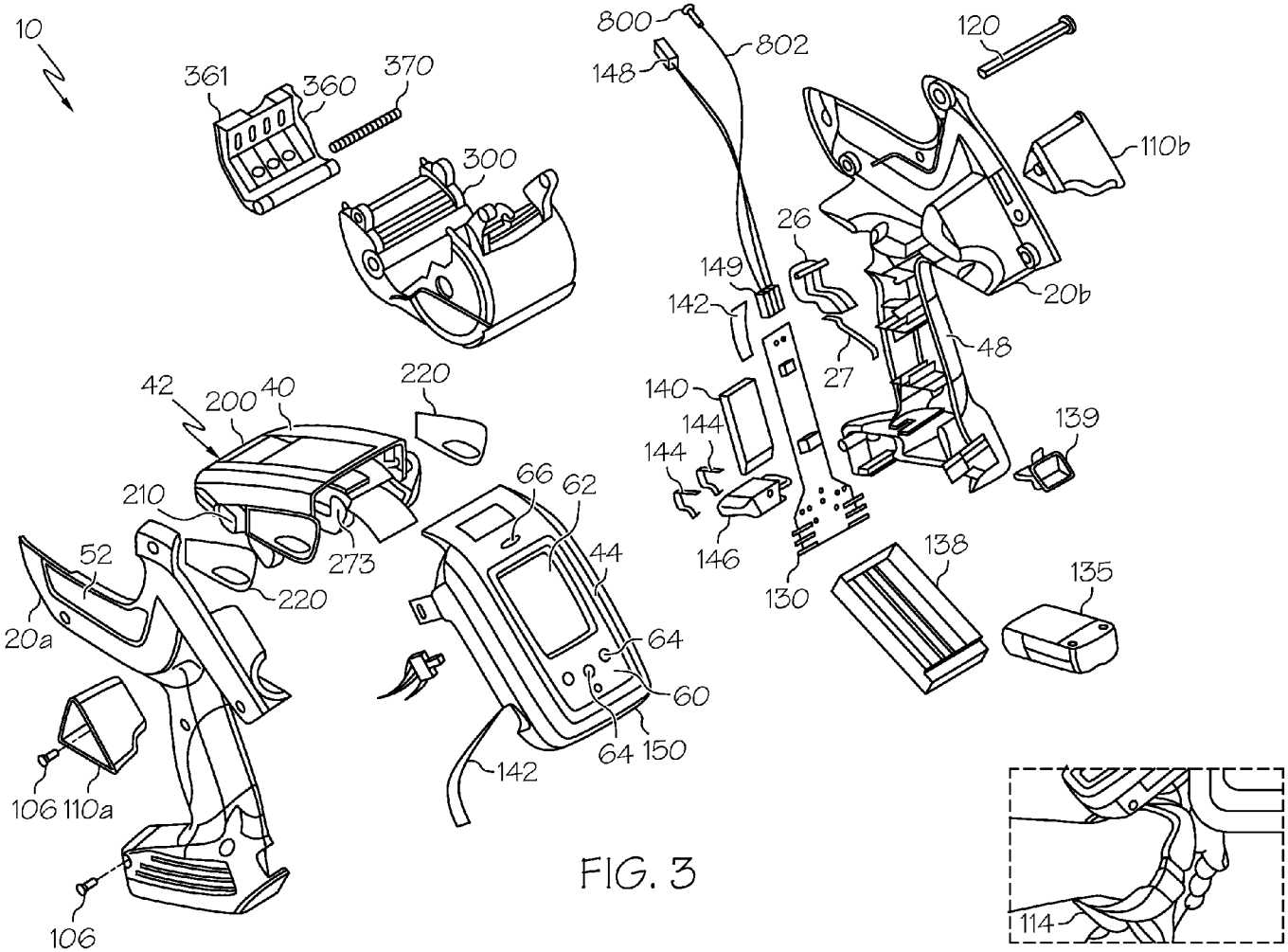
FIG. 3 is an exploded view of the labeler/printer of FIG. 1.

FIG. 3 is an exploded view of the labeler/printer 10. In this exploded view, the housing 20 is sectioned into opposing lower half sections 20*a* and 20*b*. It will be appreciated however, that the housing 20 can be provided in numerous configurations besides that depicted in the referenced figures. The labeler/printer 10 comprises an electronic module assembly 150 and a print module assembly 200. The electronic module assembly 150 generally includes the noted operator interface 60 and is incorporated along the rear face 44 of the labeler/printer 10. And the print module assembly 200 is incorporated along and in certain embodiments generally constitutes the front face 40 of the labeler/printer 10. The print module assembly 200 includes a printhead (not shown) and an associated mounting assembly (not shown). The labeler/printer 10 also comprises a drive module assembly 300. The drive module assembly 300 is generally enclosed within the main body 28 of the housing 20 and particularly, between the half sections 20*a* and 20*b* and under the print module assembly 200.

Further aspects of the labeler/printer 10 are illustrated in FIG. 3 and described as follows. The housing half sections 20*a* and 20*b* are secured to one another by one or more threaded fasteners 106. A bracket 110 is suitably provided in conjunction with the housing 20 for securing one or more optional accessories to the labeler/printer 10, e.g., such as a wrist strap 114 or other accessories. Representative bracket sections 110*a* and 110*b* are depicted in FIG. 3. Suitably, the bracket sections are received in opposite sides of an exterior opening 700 (see, e.g., FIG. 20) defined by the housing 20. In particular, an underside 702 on a rear portion of the main body 28 of the housing 20 slopes downward in a direction away from the handle 24, and the housing 20 further includes a rear face 704 on a front portion of the main body 28 and a cross member 706 extending from the rear face 704 on the front portion of the main body 28 to the downward sloping underside 702 of the rear portion of the main body 28, thereby defining the opening 700 between the cross member 706, the downward sloping underside 702 of the rear portion of the main body 28, and the rear face 704 of the front portion of the main body 28. The bracket 110 can be secured or otherwise incorporated in the opening 700 in a variety of ways, such as for example by one or more threaded fasteners 106 (see, e.g., FIG. 3). The bracket 110 may also facilitate engagement and/or use of the labeler/printer 10 in association with an optional docking station, charging cradle, or other optional equipment. The labeler/printer 10 also comprises a tie post 120 that extends between corresponding upper portions of the housing sections 20*a* and 20*b*. The tie post 120, as described in greater detail herein, serves as a hinge or pivot member about which the print module assembly 200 can be selectively pivoted between open and closed states.

Enclosed and housed between the housing sections 20*a* and 20*b* are various electronics and other components, as follows. A battery board 130 is provided for operation with a battery 135 generally carried by or accessed via a battery door 138 in the lower battery enclosure 32 illustrated in FIGS. 1 and 2. One or more flex connectors 142 are used to provide communication and power to other components, such as the electronic module assembly 150. A back-up battery 140 is optionally provided in association with the battery board 130. Associated battery contacts 144 and a contact block 146 are also provided. A cable assembly 148 provides power and/or communication to one or more components of the labeler/printer 10. The battery door 138 is suitably hingedly mounted between the housing sections 20*a* and 20*b* generally within the region constituting the battery enclosure 32 and selectively releasable by a latch component 139.

The labeler/printer 10 also comprises a trigger 26 or similar actuator assembly for at least partially controlling the operation of the labeler/printer 10. The particulars of control and/or operation are governed by software algorithm(s) stored in onboard memory provisions in the labeler/printer 10. The trigger 26 suitably actuates a pushbutton switch. A single or multi-position switch can be used as desired. Provided in association with the trigger 26 is an electrical grounding member 27. This member provides electrical communication between the trigger 26 and a grounding path provided in the labeler/printer. Suitably, the grounding member 27 also serves as a biasing member or spring to urge the trigger 26 to a default position such as outward from a depressed position.

The electronic module assembly 150 includes the previously noted operator interface 60, one or more selector buttons 64, and one or more indicator(s) 66. The previously noted flex connector 142 provides communication and power to the assembly 150. The electronic module assembly 150 is described in greater detail in association with FIG. 4.

The print module assembly 200, as previously noted, is pivotally mounted on the tie post 120. The assembly 200 is pivotally movable between (i) a closed position in which the nose end 42 is in secured engagement with the housing 20, and (ii) an open position in which the nose end 42 is spaced from corresponding regions of the housing 20 thereby providing access to an interior region of the housing 20. The print module assembly 200 is releasably secured to the housing 20 by a latch member or latch bar assembly 212 (see, e.g., FIG. 16) including a pair of latch actuators 210 arranged externally on opposite sides of the housing 20 for manual operation by a user. Suitably, a first manually movable latch actuator 210 is provided along one side such as side 52 of the housing 20 and a second manually movable latch actuator (not shown) is provided along another side such as side 48 of the housing 20. Upon manual movement of the latch actuators 210, suitably by simultaneous rearward displacement, the print module 200 is released from its closed position and may then be pivoted to an open position. As noted, the print module 200 is pivoted about the tie post 120. One or more housing panel portions or decorative members such as a pair of medallions 220 may be provided along lateral regions of the print module 200 to further enclose the interior of the housing when the print module 200 is in its closed position. The medallions 220 are suitably sized, shaped, and configured to match the housing 20 and to provide an attractive and aesthetically pleasing housing. The medallions 220 also serve as viewing windows, thereby allowing a user to observe the amount of label supply or other media remaining on a roll 5 within the housing 20. Additional details of the print module 200 are provided in conjunction with the description of FIGS. 5 and 6.

Figure 11:
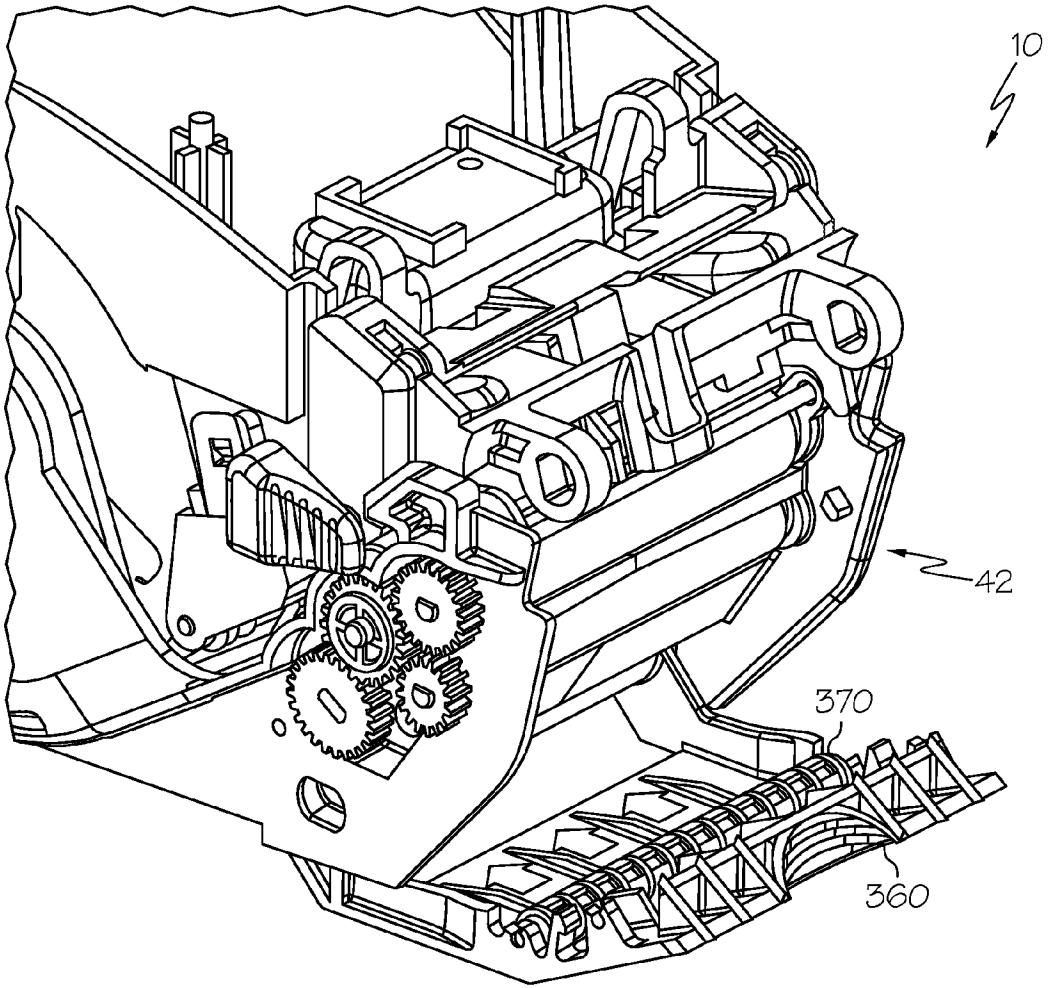
FIG. 11 is another detailed perspective view of the front end of the exemplary drive/print mechanism of the labeler/printer of FIG. 1 in which a deflector door is in an open position.

The drive module assembly 300, as previously noted, is generally disposed within the interior region of the housing 20. Specifically, the drive module assembly 300 is secured between the housing sections 20*a* and 20*b*. Also secured within the drive module assembly 300 and between the housing sections 20*a* and 20*b* is a deflector door 360 and an associated pressure roller 370. The deflector door 360 is pivotally attached to a lower region of the housing 20 proximate the front nose end 42. The deflector door 360 is pivotably moveable between (i) a closed position (as shown in FIG. 8) where the leading edge 361 is in contact with roller 286, and (ii) an open position (as shown in FIG. 11). The drive module assembly 300 is described in greater detail in conjunction with FIG. 7.

Figure 4:
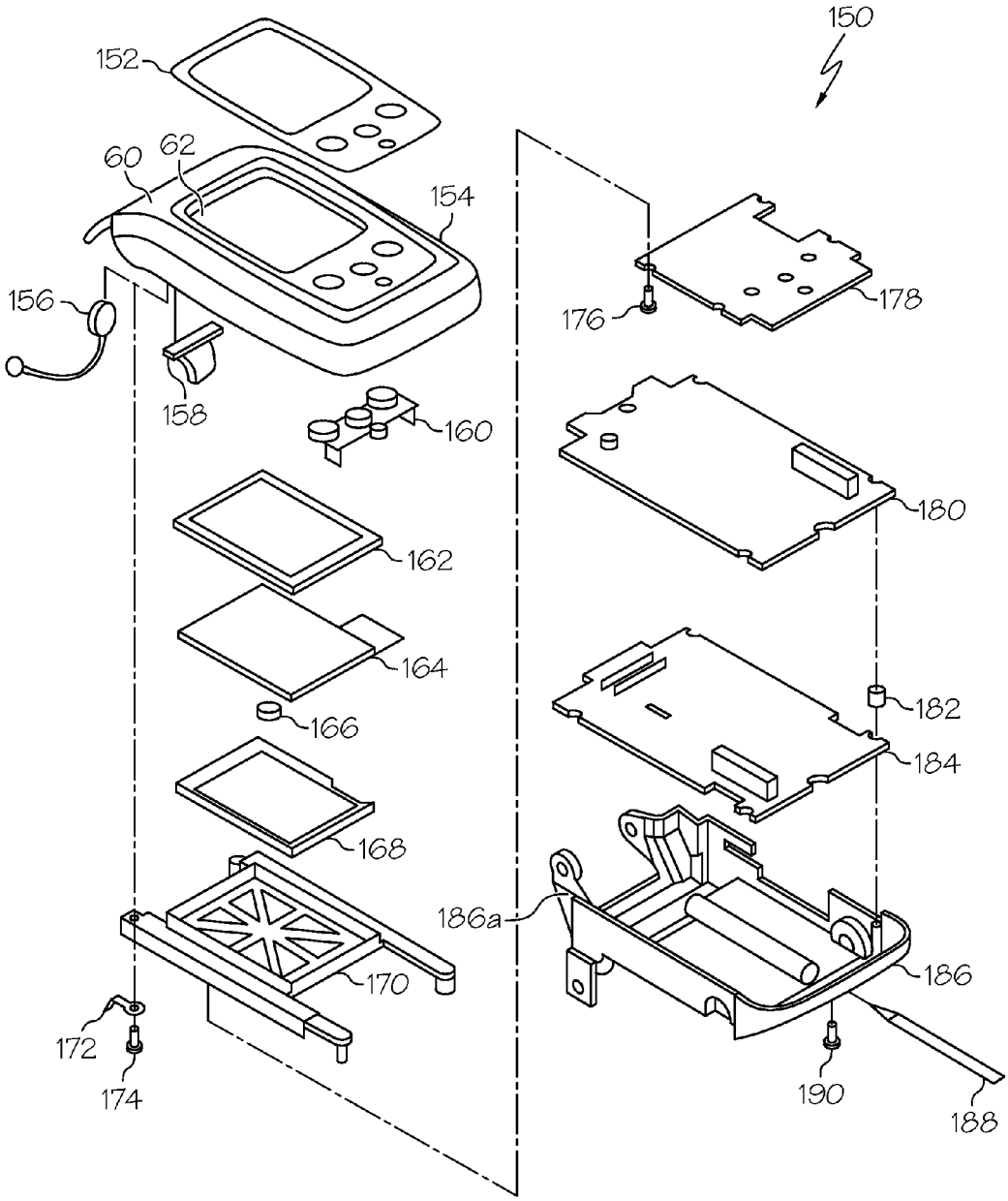
FIG. 4 is an exploded view of an exemplary electronic module assembly used in the labeler/printer of FIG. 1.

FIG. 4 is an exploded view of the electronic module assembly 150 utilized in the labeler/printer 10. As noted, the electronic module assembly 150 includes provisions for the operator interface 60. The assembly 150 comprises a front bezel 154 and a corresponding rear bezel 186 sized, shaped, and configured to engage one another and provide an enclosure for the various components of the assembly 150. A display overlay 152 can be configured to provide an outer panel for the operator interface 60. Identifying indicia, designs and/or logos, and decorative patterns or colors can be formed on an outer face of the overlay 152. It is also contemplated that such indicia and the like could be printed on an outer face of the front bezel 154 and the overlay 152 formed to be transparent or substantially so. A speaker 156 or other audio output is suitably provided in the electronic module assembly 150. A light guide 158 or other optical member is used to implement the indicator 66. A selector assembly 160 is used to provide the previously noted one or more selector buttons 64. A display assembly 164, such as an OLED (Organic Light Emitting Diode) display assembly, is included in the electronic module assembly 150. The display assembly 150 is suitably resiliently enclosed within the module assembly 150 by an upper gasket 162 and a corresponding lower gasket 168. One or more electrical grounding pads 166 are provided. A frame 170 is suitably included in the assembly 150 for mounting and otherwise securing components of the assembly 150. The electronic module assembly 150 includes electrical grounding provisions such as a contact 172 and grounding screw 174. The electronic module assembly 150 also comprises a keyboard assembly 178, one or more electronic circuit boards 180, and a printer or print engine circuit board assembly 184. The keyboard assembly 178 is suitably secured to the frame 170 by one or more fasteners 176. One or more electrically conductive spacers 182 can be used between the circuit boards 180 and 184. Additional fasteners 190 can be used to secure or otherwise retain the assembly 150 together. The electronic module assembly 150 further optionally includes a stylus 188 for assisting in initiating or activating the electronic module assembly 150.

Figure 5:
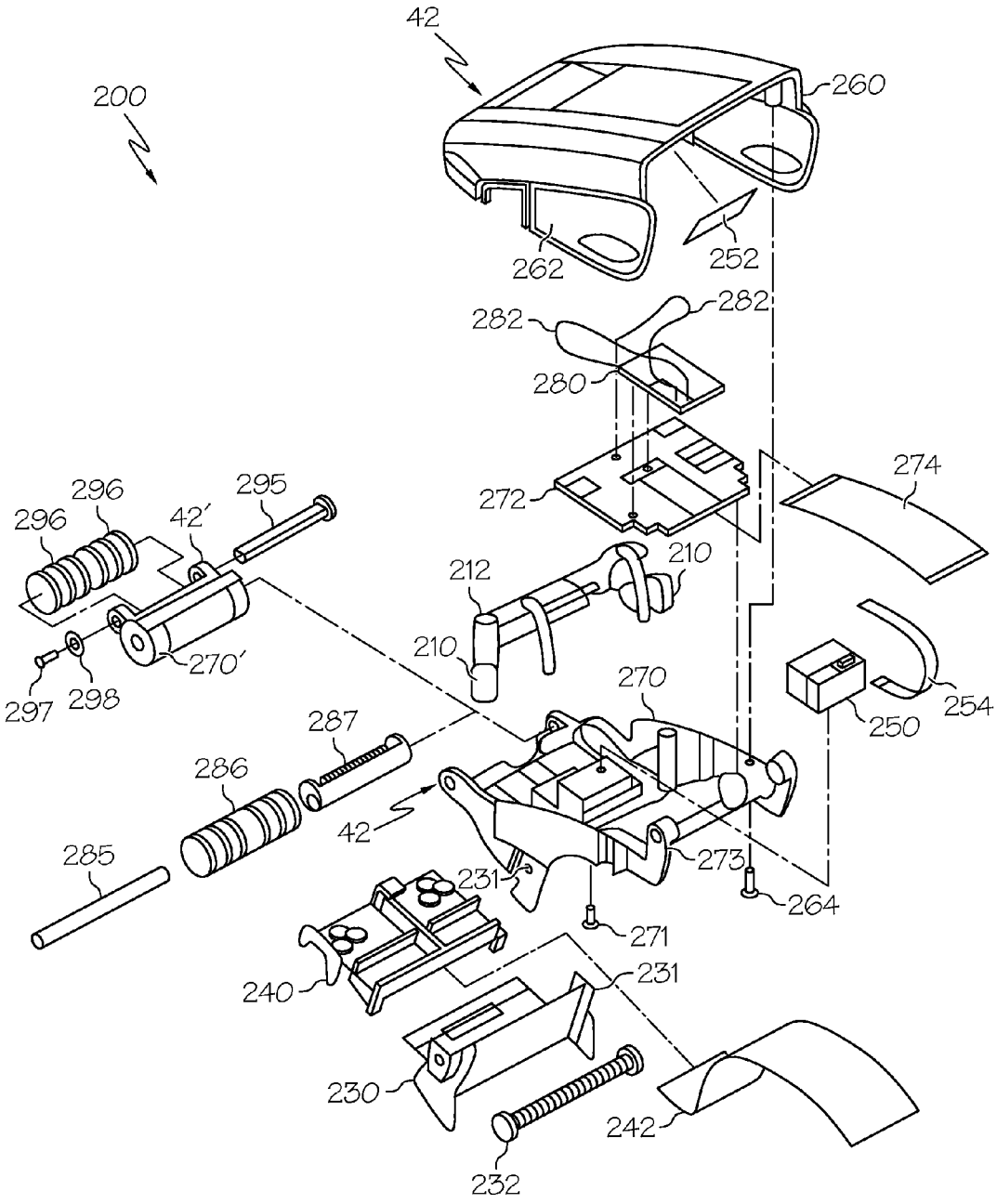
FIG. 5 is an exploded view of an exemplary print module assembly used in the labeler/printer of FIG. 1.

FIG. 5 is an exploded view of the print module assembly 200 used in the labeler/printer 10. The assembly 200 comprises a printhead retainer or retaining clip 230 and an associated transfer roller 232. Suitably, the retaining clip 230 is snap fit to the frame 270 via tabs 231 and thereby selectively retains the printhead mounting assembly 240 within the print module assembly 200. It is contemplated that the printhead retainer 230 can be configured to receive or have incorporated therein, an RFID (Radio Frequency IDentification) antenna for use with other RFID components, e.g., such as an RFID reader and/or writer incorporated in the labeler/printer 10. Optionally, the RFID antenna may be included in or on the wall or plate 230*a* (see, e.g., FIG. 19) of the retainer 230. The assembly 200 also comprises a printhead mounting assembly 240 which is illustrated in detail and described in conjunction with FIG. 6. A flex connector 242 provides electronic and power connection to the printhead (not shown) from the print engine circuit board. The print module assembly 200 may also include an optical scanner 250 secured by one or more fasteners 271 and an associated scanner lens 252. A top cover 260 is provided in conjunction with lateral panels 262 for receiving a pair of the previously noted medallions 220. The cover 260 is secured to an underlying frame 270 by one or more fasteners 264. The cover 260 and frame 270 upon engagement with one another, define an interior region for enclosing and housing a mezzanine electronic circuit board assembly 272. A flex connector 274 is used to provide electronic and power communication to the mezzanine board 272. The frame 270 can be secured to other components of the labeler/printer 10 such as portions of the housing 20, e.g., by tie post 120. A flex connector 254 provides electronic and power communication between the scanner 250 and the mezzanine board 272. The print module assembly 200 may optionally further comprise a radio card 280 which provides associated electronics for radio communication with one or more external devices, networks, systems, or items. A particular example of use of a radio card 280 is in the detection and collection of information from an RFID device. One or more coaxial jumper cables 282 are provided in conjunction with the radio card 280, for providing communication to the card 280. The print module assembly 200 also includes a latch bar assembly 212. The latch bar assembly 212 provides along its distal ends the previously described latch actuators 210. Disposed along the front nose end 42 of the print module 200 is an applicator roller post 285. In one suitable embodiment, an application roller 286 and an eccentric roller insert 287 are mounted on the roller post 285. The post 285, roller 286, and insert 287, are mounted along the front nose end 42 of the frame 270. Details as to their operation and configuration are illustrated and described herein in conjunction with FIG. 22. For certain versions of the print module assembly 200, it may be desirable to use a different roller and/or roller configuration instead of the application roller 286 and its associated components. For example, in an alternate embodiment, one or more rollers 296 supported on a roller post 295 are secured along the front nose end 42' of a frame extension 270'. One or more fasteners 297 and washer elements 298 can be used for facilitating affixment of the post 295 to the frame extension 270'. The frame extension 270' can then be secured to the front nose end 42 of the frame 270 in place of the application roller 286 and the eccentric roller insert 287, e.g., via the roller post 285 extending through a mated bore in the frame extension 270'.

Figure 6:
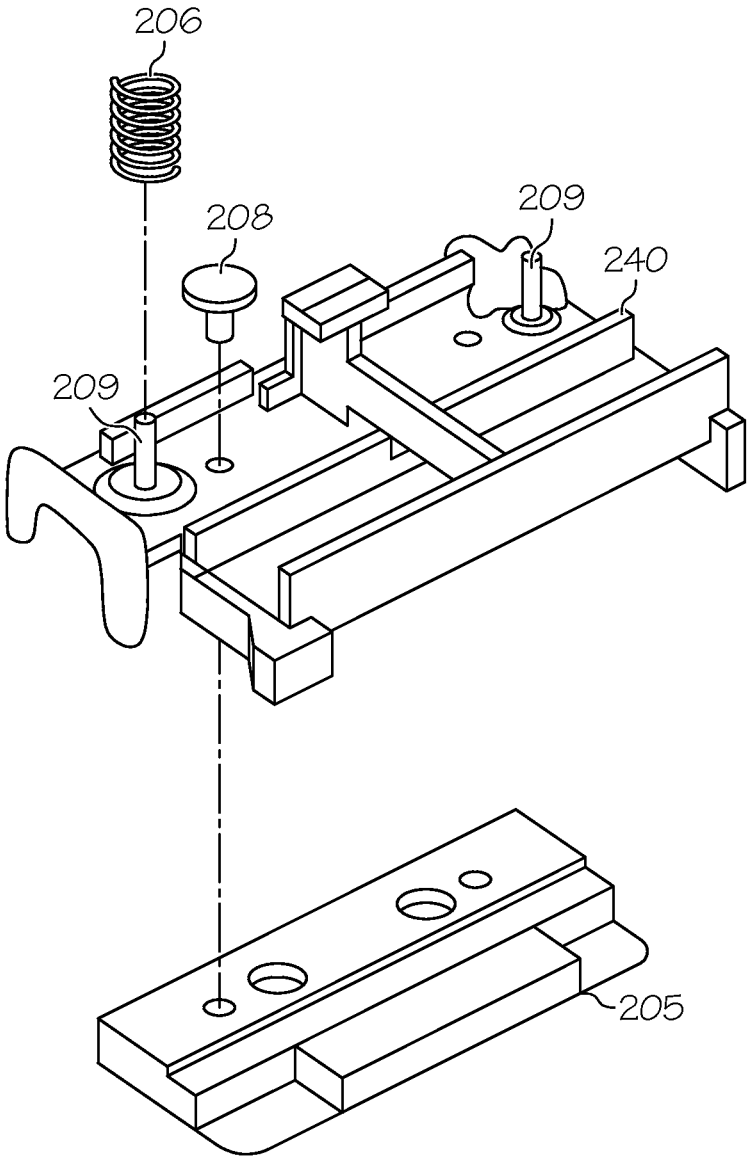
FIG. 6 is an exploded view of an exemplary printhead mounting configuration used in the labeler/printer of FIG. 1.

FIG. 6 is an exploded view of a printhead mounting configuration used in the labeler/printer 10. The printhead mounting assembly 240 (previously described in conjunction with FIG. 5), includes a segmented body configuration and uses one or more biasing elements to allow rotational positional changes of a printhead 205 about a central axis of the body, yet provide rigidity and resistance to positional displacement in other directions. Suitably, a pair of biasing members such as a spring 206 (only one spring is depicted in FIG. 6 for clarity) are provided for use in mounting and engagement of the printhead mounting assembly 240. If coil springs such as spring 206 are used for the biasing members, it is suitable that the printhead mounting assembly 240 include a corresponding number of retention posts 209 that extend from an upwardly directed face of the mounting assembly 240. The retention posts 209 serve to retain and maintain the position of a spring 206. It will be appreciated that in no way is the invention limited to this particular configuration. The printhead 205 is affixed along an underside of the assembly 240 by one or more fasteners 208. The printhead 205 is generally positioned between the underside of the assembly 240 and the printhead retainer 230 illustrated in FIG. 5. Additional details of those components are provided herein.

Figure 7:
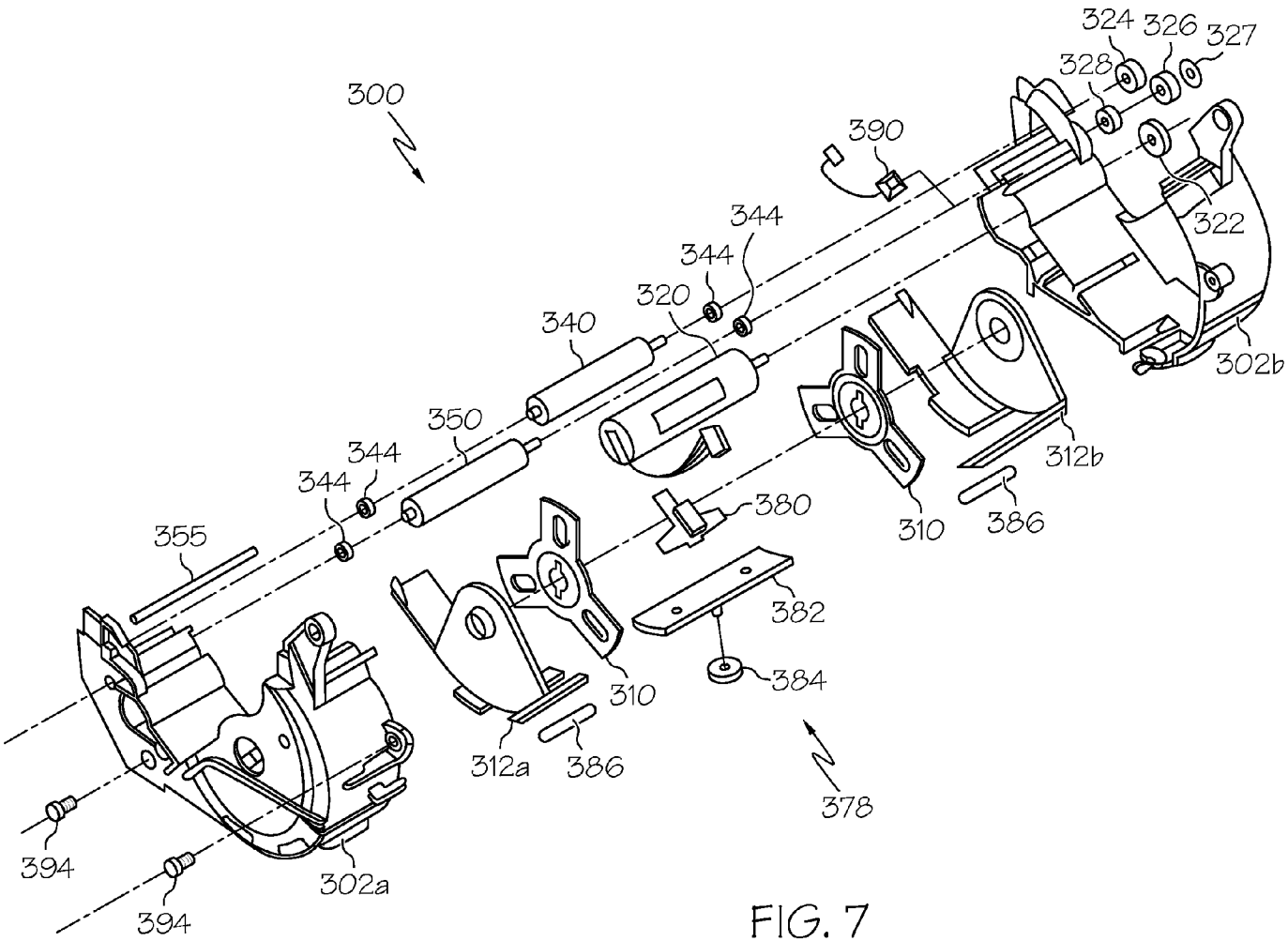
FIG. 7 is an exploded view of an exemplary drive module assembly used in the labeler/printer of FIG. 1.
Figure 8:
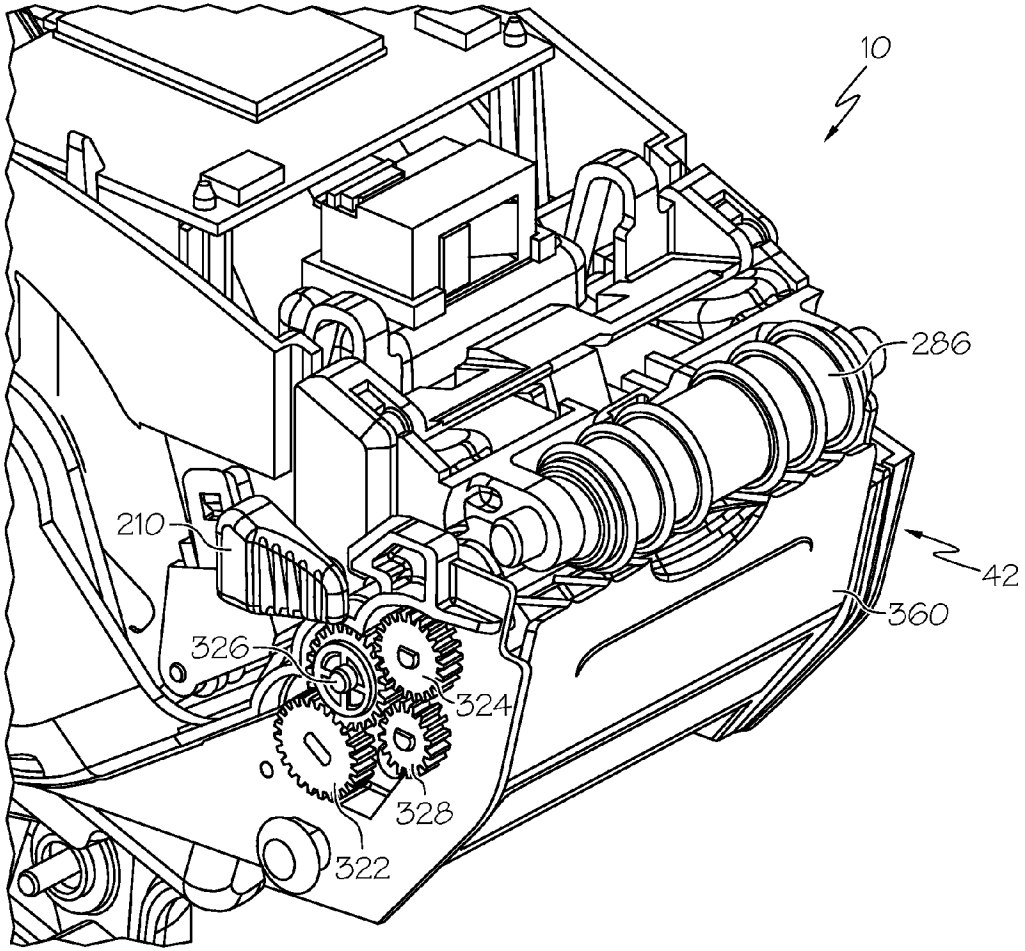
FIG. 8 is a detailed perspective view of the front end of the labeler/printer of FIG. 1 revealing aspects of an exemplary drive/print mechanism and an exemplary latch assembly.

FIG. 7 is an exploded view of the drive module assembly 300 used in the labeler/printer 10. The assembly 300 comprises a pair of frame sections 302*a* and 302*b*. The frame sections 302*a* and 302*b* are sized, shaped, and configured to engage one another and provide an interior region within which are disposed various components as follows. One or more, and suitably two, supply flanges 310, and one or more, and suitably two, supply holders 312*a* and 312*b* are movably disposed within the interior region defined between the frame sections 302*a* and 302*b*. Each flange 310 is rotatably engaged with a corresponding holder 312*a* and 312*b*. As described in greater detail herein, the sets of flanges 310 and holders 312*a* and 312*b* can be selectively positioned at different distances from one another to thereby accept and retain a wound roll of paper or media for use with the labeler/printer 10. The drive module assembly 300 also comprises an electrically powered motor 320 mountedly disposed within the frame sections 302*a* and 302*b*. The motor 320 provides rotational power to a drive gear 322. The drive gear 322 is engaged with a platen gear 324 and a liner drive gear 328, suitably via one or more idler gears 326. All or a portion of the gears described herein can be retained to a frame section such as section 302*b* by a retaining clip 327. Powered rotation of the platen gear 324 imparts rotation to a platen roller 340. And, powered rotation of the liner drive gear 328 imparts rotation to a liner drive roller 350. Each roller 340 and 350 is rotatably supported and mounted between the frame sections 302*a* and 302*b*. Although a wide array of mounting configurations can be used, suitably each of the platen roller 340 and the liner drive roller 350 are rotatably received by a pair of bearings 344 disposed in aligned apertures in the frame sections 302*a* and 302*b*. The drive module assembly 300 also comprises a peel roller 355 also extending between the frame sections 302*a* and 302*b*. The operation of these components is described in greater detail herein.

Figure 15:
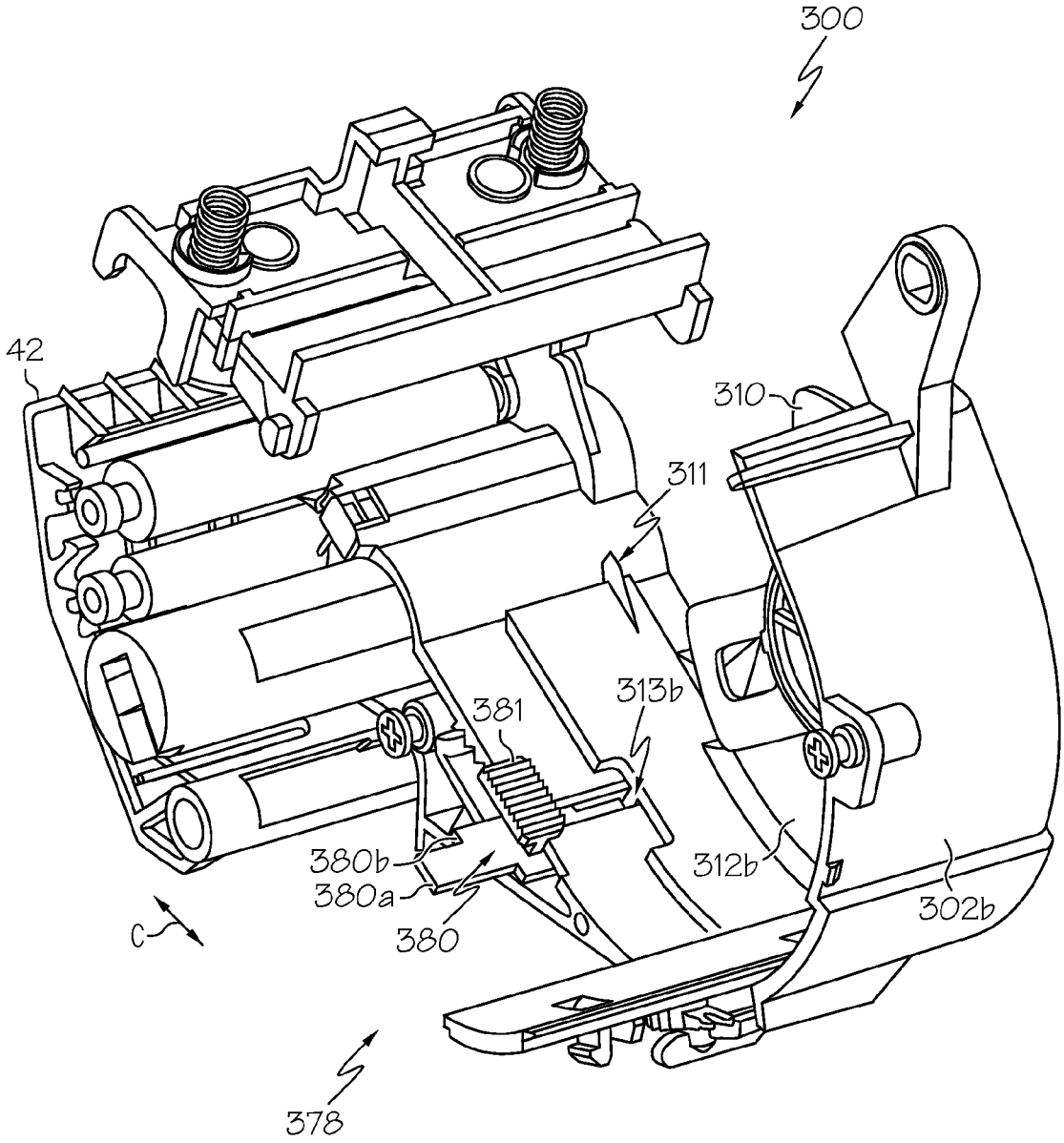
FIG. 15 is a rear perspective view of the drive assembly having certain components removed to reveal a spacing selector assembly.

Referring further to FIG. 7, as noted, the spacing between the two sets of the supply flange 310 and the supply holders 312*a* and 312*b* is selectively variable. Thus, a user can selectively position each set of flange 310 and holder 312*a*, 312*b* along their axis of rotation within the interior region defined between the frame sections 302*a* and 302*b*. Suitably, relative spacing between the sets of flanges and holders may be biased to one or more predetermined default spaces. This feature enables the sets of flanges 310 and holders 312*a*, 312*b* to be readily adjusted to fittingly receive wound rolls of paper or media of common or industry standard widths. A stop guide 380, a retainer 382, and an idler gear 384 provide this feature and are periodically referred to herein as a spacing selection assembly 378. The stop guide 380 is slidably positionable and depending upon its position, laterally displaces corresponding cam followers formed on the supply holders 312*a* and 312*b* and thereby positions the holders 312*a* and 312*b* apart or closer together. For example, one cam follower 313*b* formed on the supply holder 312*b* is illustrated in FIG. 15. Suitably, a similar cam follower (now shown) is also formed on the supply holder 312*a*. Since the flanges 310 are mounted on and thus carried by the supply holders 312*a* and 312*b*, the flanges 310 are also linearly displaced relative to one another as the stop guide 380 is repositioned. One or more biasing members or springs 386 can be used to urge the sets of flanges 310 and holders 312*a* and 312*b* apart or closer together. Additional details of the spacing selection assembly 378 are provided in FIG. 15 and the associated description herein. As will be understood, the frame sections 302*a* and 302*b* can be secured to one another in a variety of different ways. One or more threaded fasteners 394 are suitably used.

One or more sensors 390 can be used to detect indexing and/or other like marks on an underside of the web or media threaded through the labeler/printer 10. Suitably, a backside or surface such as the wall or plate 230*a* of the print head retainer 230 defines at least a portion of the web path and limits the distance at which the web can pass by the sensor 390, thereby aiding accurate sensor readings of indexing and/or other like marks on an underside or back surface of the web.

FIG. 8 is a detailed perspective view of the front nose end 42 of the labeler/printer 10 revealing various aspects of the drive module assembly 300 and the print module assembly 200 generally positioned above the drive module assembly 300. In FIG. 8, the labeler/printer 10 is shown without associated covers or housings to better reveal the interior of the labeler/printer 10. Drive gear 322 is illustrated showing its engagement with the platen gear 324 and the liner drive gear 328 via the idler gear 326. The application roller 286 associated with the print module assembly 200 is suitably positioned forwardly and above the gears. A unique feature of the labeler/printer 10 is the location of the application roller 286. Locating the roller 286 relative to other components along the front nose end 42 while retained in the pivotable print module assembly 200 as shown eliminates or at least significantly simplifies "threading" paper, media or web through the labeler/printer 10 during supply loading. The deflector door 360 is also shown, located immediately below the application roller 286. As explained in greater detail herein, the deflector door 360 is positionable between a closed state (shown in FIG. 8) and an open state. Latch actuators 210 are suitably located along lateral side regions of the labeler/printer 10 and upon actuation, enable the print module assembly 200 to be released so that it may pivot from a closed position shown in FIG. 8 to a raised or open position, thereby enabling access into the interior of the labeler/printer 10.

Figure 9:
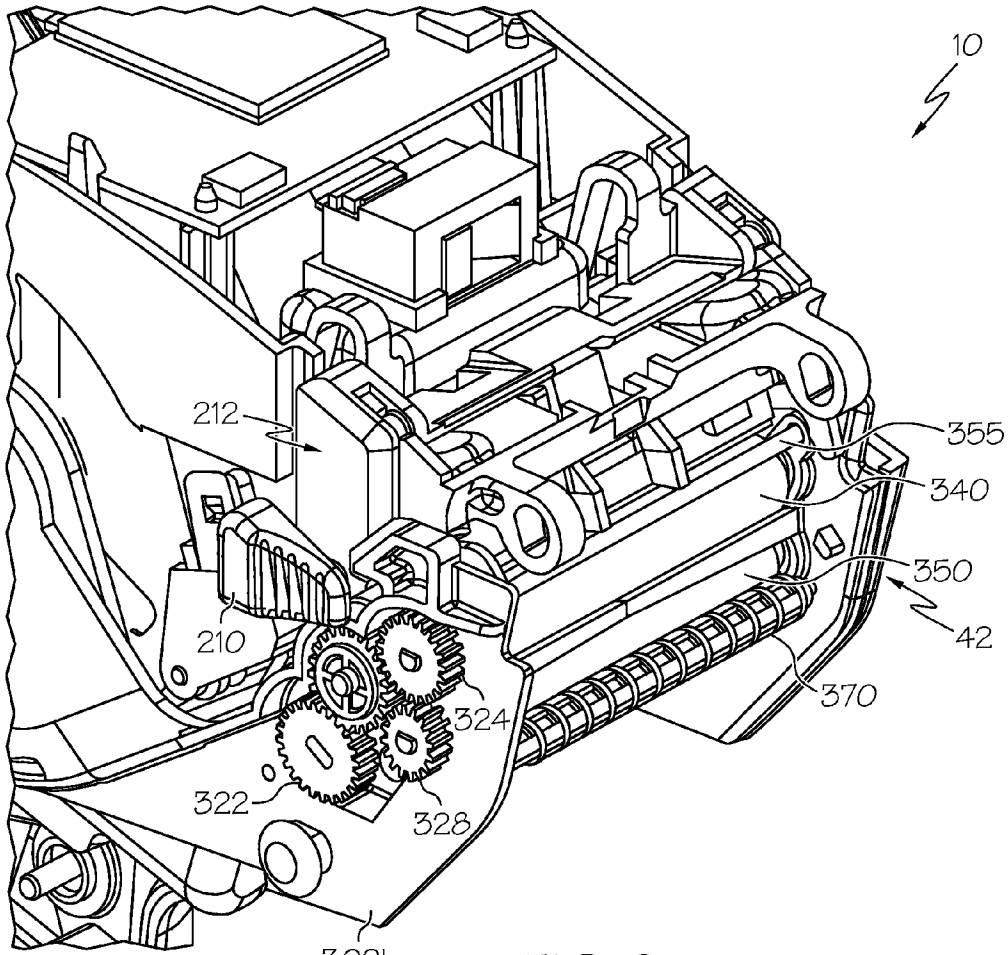
FIG. 9 is another detailed perspective view of the front end of the labeler/printer of FIG. 1.

FIG. 9 is another detailed perspective view of the front nose end 42 of the labeler/printer 10 illustrating further aspects thereof. In this view, the application roller 286 has been removed along with the deflector door 360 for greater clarity. As can be seen, the platen roller 340 is disposed above the liner drive roller 350. Optionally, the liner drive roller 350 is over-driven with respect to the platen roller 340. That is to say, the liner drive roller 350 is rotatably driven at a speed or amount greater than the platen roller 350. This configuration serves to maintain tension on a liner layer described in greater detail herein. Increased tension on the liner promotes separation of a label or facestock layer from the liner, particularly as the liner is pulled over the peel bar or roller 355. This is described in greater detail in conjunction with FIG. 22 which illustrates a paper path defined in the labeler/printer 10. Another unique feature of the labeler/printer 10 is the location of the liner drive roller 350. Locating the roller 350 relative to other components as shown in FIG. 9 eliminates or at least significantly simplifies "threading" paper or web through the labeler/printer. The liner drive roller 350 is generally located below the platen roller 340 and in contact with the pressure roller 370. As previously described, the pressure roller 370 is rotatably supported and mounted on the deflector door 360 which is not shown in FIG. 9 for greater clarity. As previously noted, rollers 340 and 350 are driven by gears 324 and 328, respectively. Only a portion of the drive frame section 302 is depicted. The latch actuator 210 and its associated latch bar assembly 212 is also shown.

Figure 10:
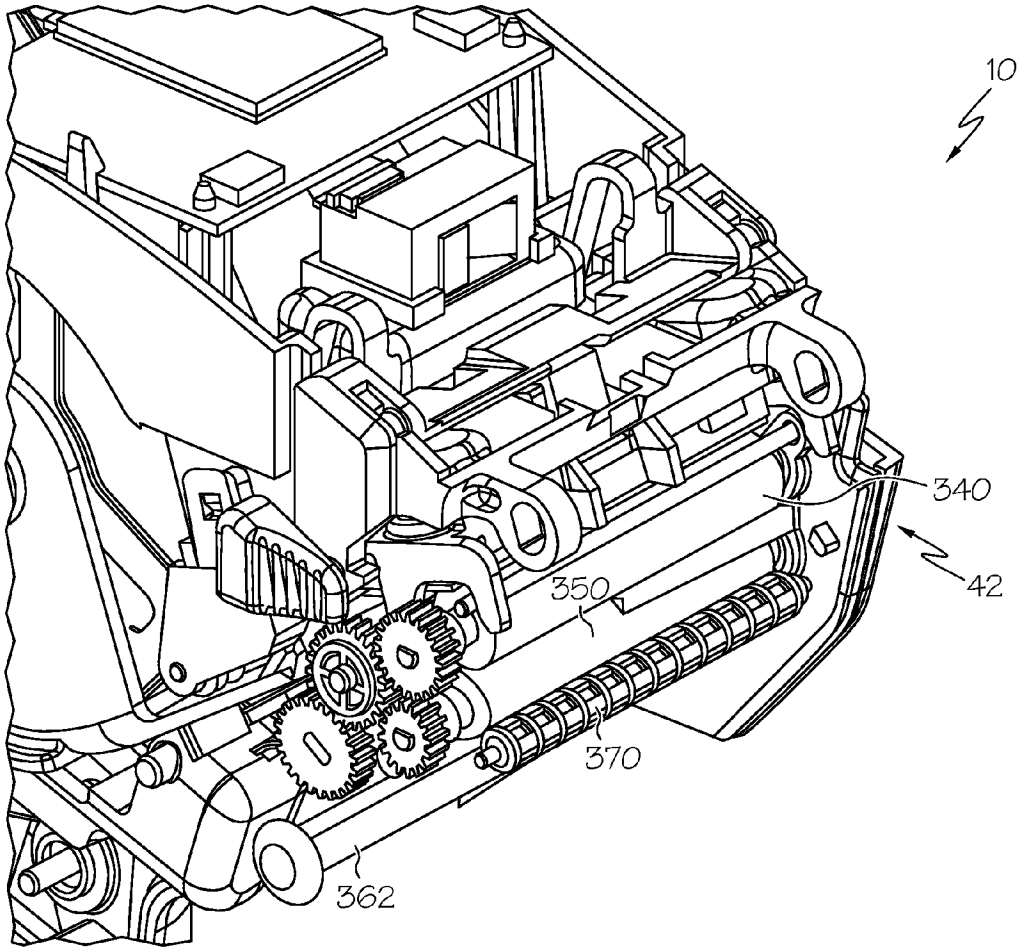
FIG. 10 is yet another detailed perspective view of the front end of the labeler/printer of FIG. 1.

FIG. 10 is another detailed perspective view of the front nose end 42 of the labeler/printer 10 revealing additional aspects thereof. In this view, the various housing portions and covers have been removed, the deflector door 360 is removed, application roller 286 is removed and a right hand side portion of the drive frame section 302*b* has been removed for greater clarity. FIG. 10 illustrates the relative positions of the pressure roller 370 and the liner drive roller 350 when the deflector door (not shown) is closed. As can be seen, the pressure roller 370 is in close proximity and suitably in contact with the liner drive roller 350. The liner deflector door (not shown) is hingedly or pivotally mounted on a hinge post 362 or other suitable member along the front region of the labeler/printer 10.

FIG. 11 is yet another detailed perspective view of the front nose end 42 of the labeler/printer 10. In this view, various housing and cover portions have been removed along with certain electronics and the application roller 286, and the deflector door 360 is depicted in an open position. The pressure roller 370 is rotatably supported along an interior face of the deflector door 360. Mechanical stops are provided in the hinge assembly for the deflector door 360 so that the door does not extend beyond its fully open state depicted in FIG. 11.

Figure 12:
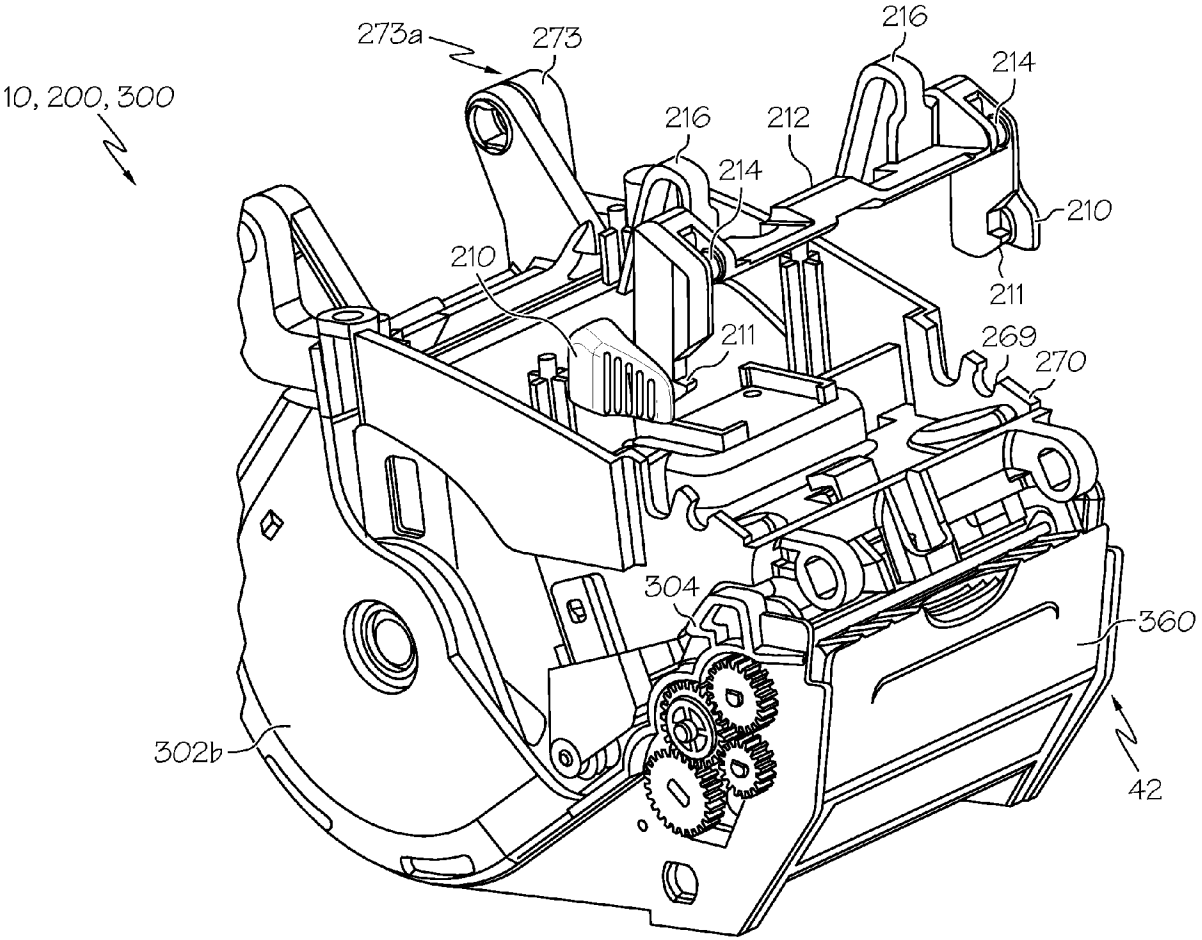
FIG. 12 is another detailed perspective view of the front end of the exemplary drive/print mechanism of the labeler/printer of FIG. 1 in which the deflector door is closed, and the latch assembly is disengaged from the front end.

FIG. 12 is a front perspective view of a subassembly of a portion of the print module assembly 200 and a portion of the drive module assembly 300 of the labeler/printer 10 in conjunction with other components. Specifically, the latch bar assembly 212 and laterally disposed latch actuators 210 are shown removed from their engagement with the frame 270 of the print module assembly 200. Laterally located and partially exposed support members 214 are fittingly received in apertures 269 defined in the frame 270 of the print module assembly 200. The latch bar assembly 212 engages the frame 270 of the print module assembly 200 and is suitably retained therewith by the pair of apertures 269 and biased rotatably forward by biasing frame members 216. Due to the arcuate inverted U-shaped configuration of the frame members 216, the forward portion of the bar assembly 212, particularly the portion carrying the latch actuators 210, can be forwardly or rearwardly displaced. Thus, by forward or rearward displacement of the latch actuators 210 and associated latch fingers 211 relative to a corresponding stationary latch engagement member 304 in the drive module assembly frame 302, the latch bar 212 and pivotable print module assembly 200 can be selectively secured to or released from affixment with the frame 302 of the drive module assembly 300. The provision of dual latch actuators 210, each accessible and provided on opposite side regions of the labeler/printer 10 along with the rearward action or movement used to operate the latch actuators 210 greatly minimizes or in many instances, eliminates unintended or accidental actuation of the latch assembly which could otherwise potentially occur if the labeler/printer 10 is laid on its side by an operator.

Figure 13:
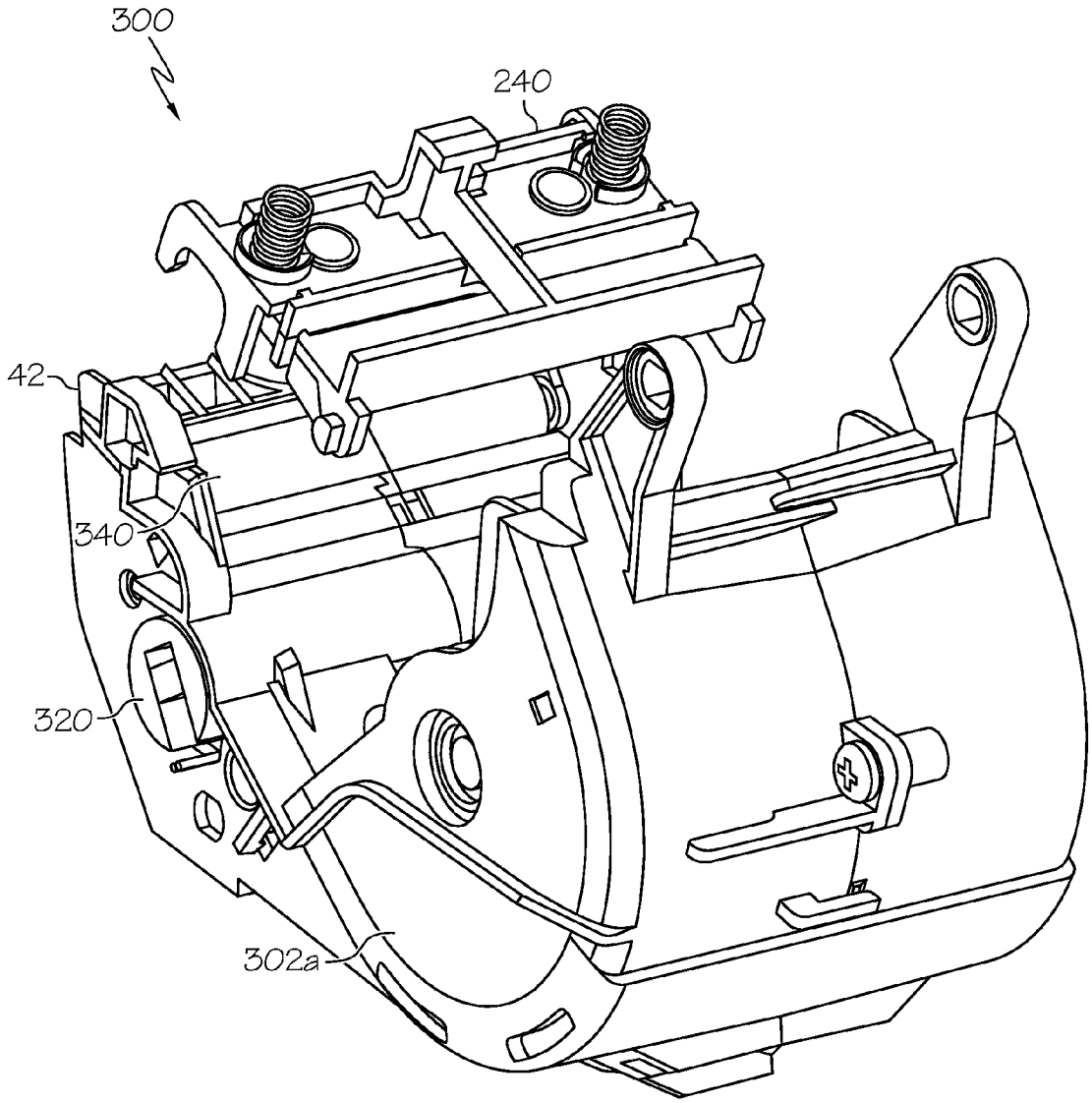
FIG. 13 is a rear perspective view of the drive assembly used in the labeler/printer of FIG. 1 shown in conjunction with a printhead mounting assembly.

FIG. 13 is a rear perspective view of the drive assembly 300 in conjunction with the printhead mounting assembly 240. It will be understood that upon assembly and incorporation of the printhead mounting assembly 240 in the print module assembly 200, the underside of the printhead mounting assembly 240 at which is located the printhead (not shown) is in close proximity to the platen roller 340 so that paper or other material passes underneath and is immediately adjacent to the printhead 205. This configuration is illustrated and described in conjunction with FIGS. 21 and 22. The motor 320 is also illustrated in FIG. 13 and its orientation in the drive assembly 300.

Figure 14:
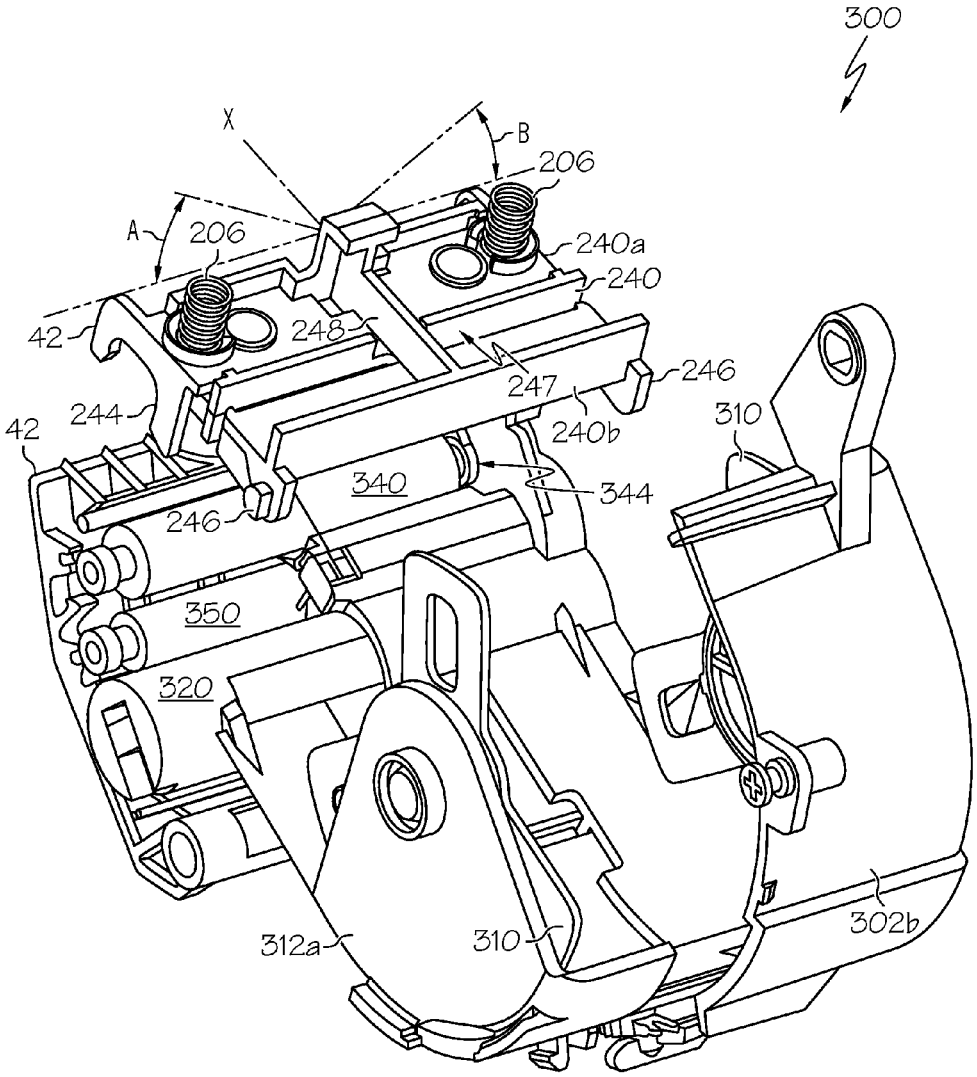
FIG. 14 is a rear perspective view of the drive assembly revealing various rollers and relative location and orientation with the printhead mounting assembly.

FIG. 14 is another rear perspective view of the drive assembly 300 and the printhead mounting assembly 240 as depicted in FIG. 13, however partially disassembled. Specifically, FIG. 14 reveals the drive assembly 300 having a portion of the left hand side drive frame section 302*a* removed. In addition, the printhead mounting assembly 240 is spaced from the platen roller 340 for greater clarity. The sets of supply flanges 310 and supply holders 312*a* and 312*b* mounted within the drive frame sections 302*a* and 302*b* are illustrated. FIG. 14 illustrates a mounting configuration for the printhead mounting assembly 240. Suitably, the assembly 240 defines a pair of forwardly directed alignment or locating surfaces 244 which, upon assembly of the printhead mounting assembly 240 in the labeler/printer 10, directly contact exposed regions of the bearings 344 associated with the platen roller 340. This configuration between alignment surfaces 244 and platen roller bearings 344 ensures proper and consistent positioning of the printhead (not shown) retained along the underside of the assembly 240 and the platen roller 340 upon which is carried paper or other stock to receive printing. The printhead mounting assembly 240 also provides a pair of rearwardly located and laterally projecting mounting pins 246. Each pin 246 is received in horizontal slots of an upper frame (not shown) in the print module assembly 200. As noted, the printhead mounting assembly 240 suitably has a segmented body to enable the assembly 240 to undergo deformation and/or movement in certain directions while resisting such and thereby provide support with respect to force loadings in other directions. Suitably, the assembly 240 includes a center rib 248 that extends substantially the entire length from front to back of the assembly 240 and connects a frontward portion 240*a* of the assembly 240 and a rearward portion 240*b* of the assembly 240 to one another with a gap between the aforementioned frontward and rearward portions 240*a* and 240*b*. As shown, the rib 248 comprises a vertical wall which is flexible to twisting about its longitudinal axis X, while remaining substantially rigid to bending vertically about this axis. In the illustrated embodiment, one or more slots or regions of separation 247 define the aforementioned gap. Suitably, the assembly 240 has two symmetrically arranged slots 247 extending laterally outward from the center rib 248. This configuration enables rotational or "gimbal" movement of a frontward portion 240*a* of the assembly 240 about the axis X such as shown by arrows A and B, while the rearward portion 240*b* of the assembly 240 is secured or mounted to one or more frame members within the labeler/printer 10. The biasing members 206 bias the frontward portion of the assembly 240 toward an aligned position with respect to the platen roller 340, while still allowing the printhead 205 mounted under the frontward portion 240*a* to gimbal with respect to the underlying platen roller 340 along with the corresponding movement of the frontward portion 240*a* of the assembly 240.

FIG. 15 is a rear perspective view of the drive module assembly 300, similar to FIG. 14, illustrating the spacing selection assembly 378 for conveniently positioning the sets of supply flanges 310 and supply holders 312*a* and 312*b* in one of several predetermined spaced arrangements. In this figure, the left hand side drive frame 302*a* and left hand side supply holder 312*a* and associated flange 310 are not shown for greater clarity of the spacing selection assembly 378. Specifically, with reference to both FIGS. 7 and 15, the spacing selection assembly 378 includes the stop guide 380 having an outwardly facing contact member 381 that can be serrated or otherwise roughened to promote engagement by a user. The stop guide 380 is slidably retained within a channel (not shown) defined in the frame sections 302*a* and 302*b* of the drive module assembly 300. The stop guide 380 is selectively movable in forward or rearward directions shown by arrow C in FIG. 15. Defined along lateral side regions of the stop member 380 are a collection of cam or stop surfaces 380*a* and 380*b*. Ribs or cam followers (e.g., such as the illustrated cam follower 313*b*) extending from the supply holders 312*a* and 312*b* contact one of the stop surfaces or none. The selection of the surface 380*a*, 380*b* or none that contacts the rib(s) or cam follower(s), depends upon the position of the stop member 380 along a path extending in a direction of arrow C.

Each supply holder 312 also suitably includes a projecting supply guide 311. The supply guides 311 serve to contact an outer edge of the other webbing used in the labeler/printer 10, thereby promoting additional guidance of the web within the labeler/printer 10 between the roll 5 and the nip. The present invention includes a wide variety of different versions of the spacing selection assembly 378. For example, the provision of a greater number of default spacings, such as four, five, or more, can be readily provided by increasing the number of stop surfaces of the stop guide 380.

Figure 16:
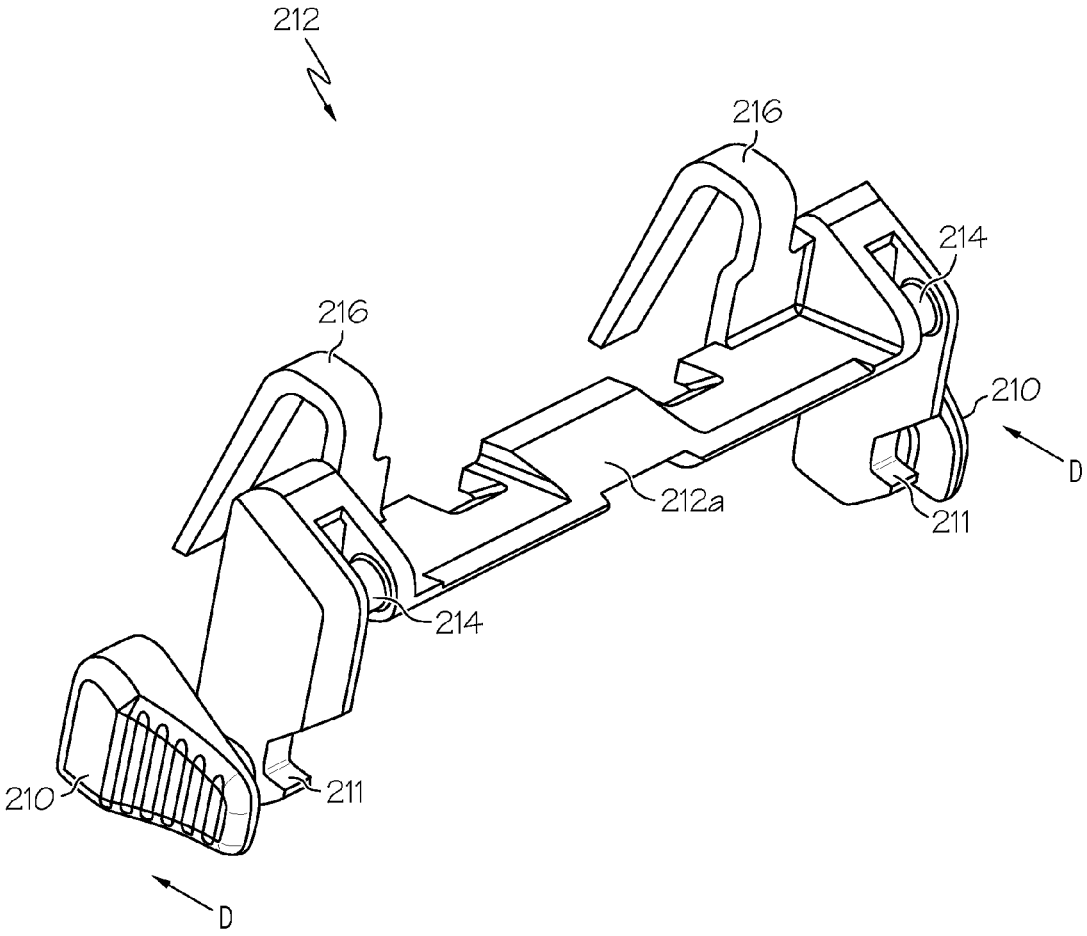
FIG. 16 is a perspective view of a latch bar assembly the labeler/printer of FIG. 1.

FIG. 16 is a perspective view of the latch bar assembly 212 used in the labeler/printer 10. The latch bar assembly 212 includes two distally disposed latch actuators 210 arranged at opposing ends of a longitudinally extending central portion 212*a*. As previously explained, the latch bar assembly 212 also includes two longitudinally aligned support members 214 that are supported in a pair of mating apertures in the print module frame (not shown) when the print module assembly is positioned in its closed state. The latch bar assembly 212 also includes a pair of biasing frame members 216 that provide a biasing action upon rotation of the assembly 212 abut support members 214 such as during displacement of the latch actuators 210 in a direction indicated by arrows D occurring during a latching operation upon closing the print module assembly 200 or a de-latching operation upon opening the print module assembly 200. As previously described, the latch bar assembly 212 defines a pair of fingers 211, suitably sized, shaped and configured to engage with corresponding latch engagement members or catches of the drive module assembly (not shown), upon securing the print module assembly thereto. It will be understood that the print module assembly 200 is disengaged from the drive module assembly 300 and hence, remainder of the labeler/printer, by displacement of the latch actuators 210 such as in the direction of arrow D, thereby also effecting linear displacement of the fingers 211 so that the fingers are disengaged from the stationary latch engagement members 304 of the drive module assembly 300. It should be noted that in the illustrated embodiment the latch bar assembly 212 is a one-piece molded plastic part, it is not limited to such a construction.

Figure 17:
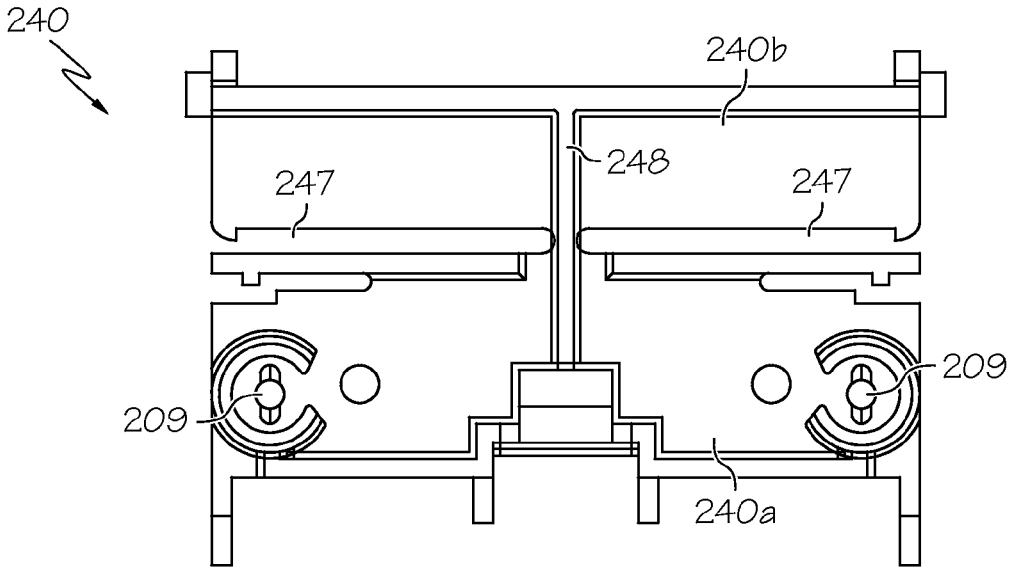
FIG. 17 is a top view of the printhead mounting assembly used in the labeler/printer of FIG. 1.
Figure 18:
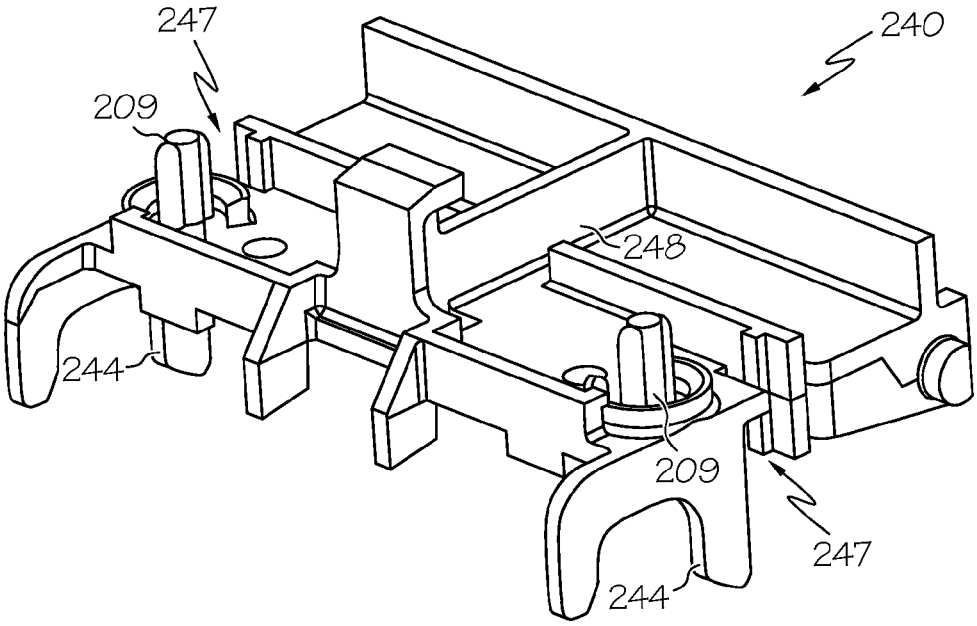
FIG. 18 is a front perspective view of the printhead mounting assembly depicted in FIG. 17.

FIGS. 17 and 18 illustrate the printhead mounting assembly 240 in greater detail. The printhead mounting assembly 240, as previously explained, suitably includes a segmented body that enables torsional movement about a central axis as depicted in FIG. 14. The central axis is collinear with a center rib 248. A pair of slots or regions of separation 247 generally extend from the rib 248 along a mid-region of the assembly 240 to lateral edge regions. The regions 247 facilitate torsional displacement of the assembly 240 about the center rib 248. The assembly 240 also includes one or more, and suitably two, upwardly extending retention posts 209 for receiving and aligning corresponding biasing elements such as coil springs that serve to apply a biasing load on the front portion 240*a* of the assembly 240. The assembly further includes provisions for promoting alignment of the assembly 240 and printhead (not shown) and in cooperation with an underlying platen roller (not shown). These alignment provisions are suitably in the form of a pair of upwardly extending slots formed in lateral regions of the assembly 240 which provide forwardly directed alignment or locating surfaces 244 that upon incorporation in the labeler/printer, directly abut or contact an outer surface of bearings (not shown) that rotatably support the platen roller. Although the segmented body of the printhead mounting assembly 240 can be formed in a plurality of separate components, it is suitable that the body be integrally formed and that the material selection and structural design parameters dictate the torsional loading and response characteristics of the body. This enables precise and consistent behavior of the assembly 240 under a variety of operating conditions.

Figure 19:
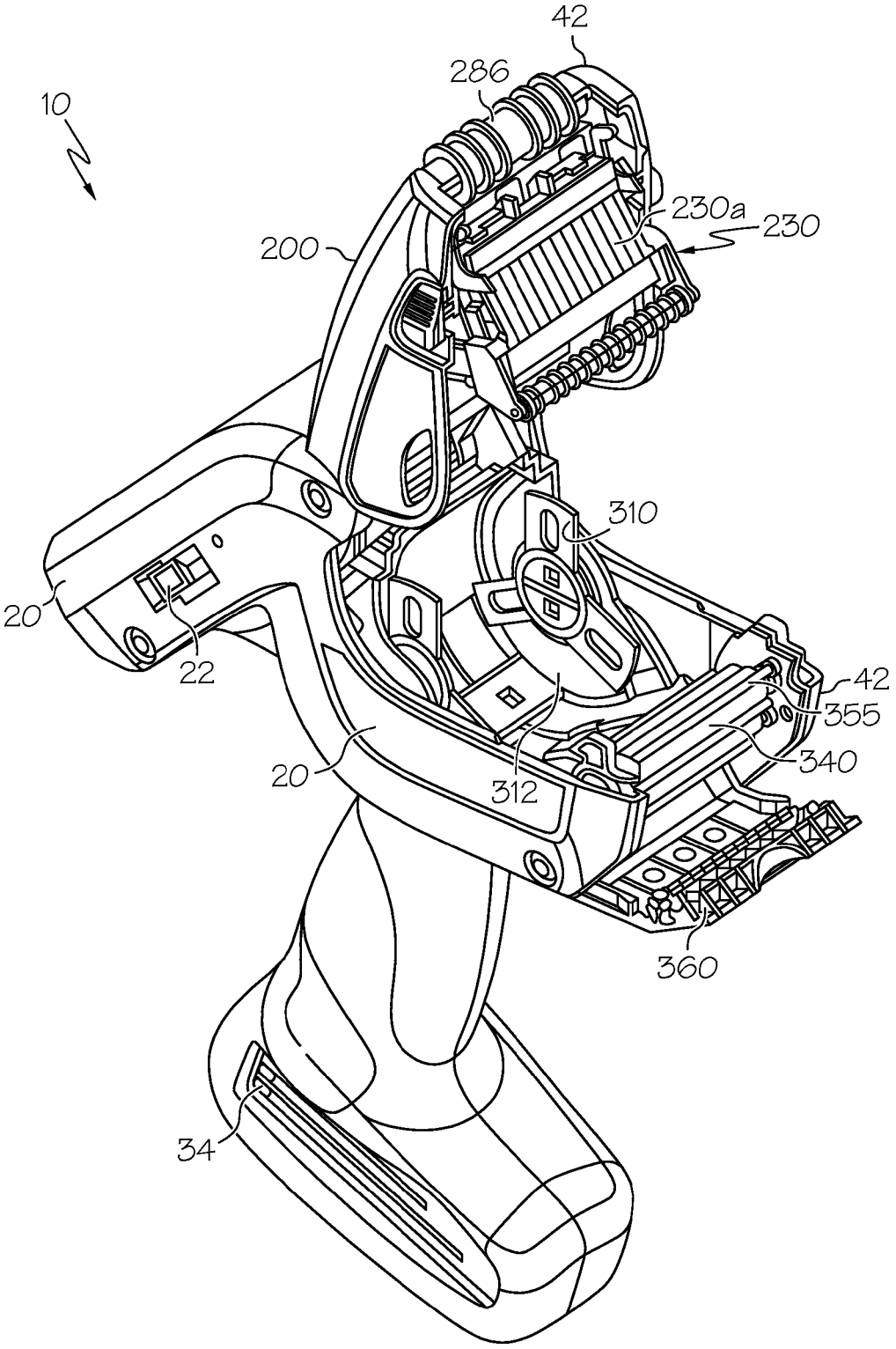
FIG. 19 is a front perspective view of the labeler/printer of FIG. 1 having its print module assembly positioned in an open state and the deflector door positioned in an open state.

FIG. 19 is a front perspective view of the labeler/printer 10 illustrating the print module assembly 200 in an open position, and the deflector door 360 in an open position. Located along the front nose end 42 of the print module 200 is the application roller 286. Disposed along the front nose end 42 of the housing 20, and accessible once the deflector door 360 is opened, the platen roller 340 and peel roller 355 are exposed. Opening the print module 200 to its opened position depicted in FIG. 19 reveals the interior of the labeler/printer 10 and a spaced void between the two sets of supply flanges 310 and supply holders 312*a* and 312*b*, for receiving a roll of paper or other rolled media. Another significant feature of the labeler/printer 10 is the provision of electrical grounding components that provide an electrical grounding path to the print module assembly 200, and in particular, to the printhead (not shown) regardless of the position of the print module assembly 200, e.g. either open, closed, or at any position therebetween. Suitably, the ground path is provided from the printhead 205 to a ground source in the labeler/printer 10, by a ground wire or conductor.

Figure 20:
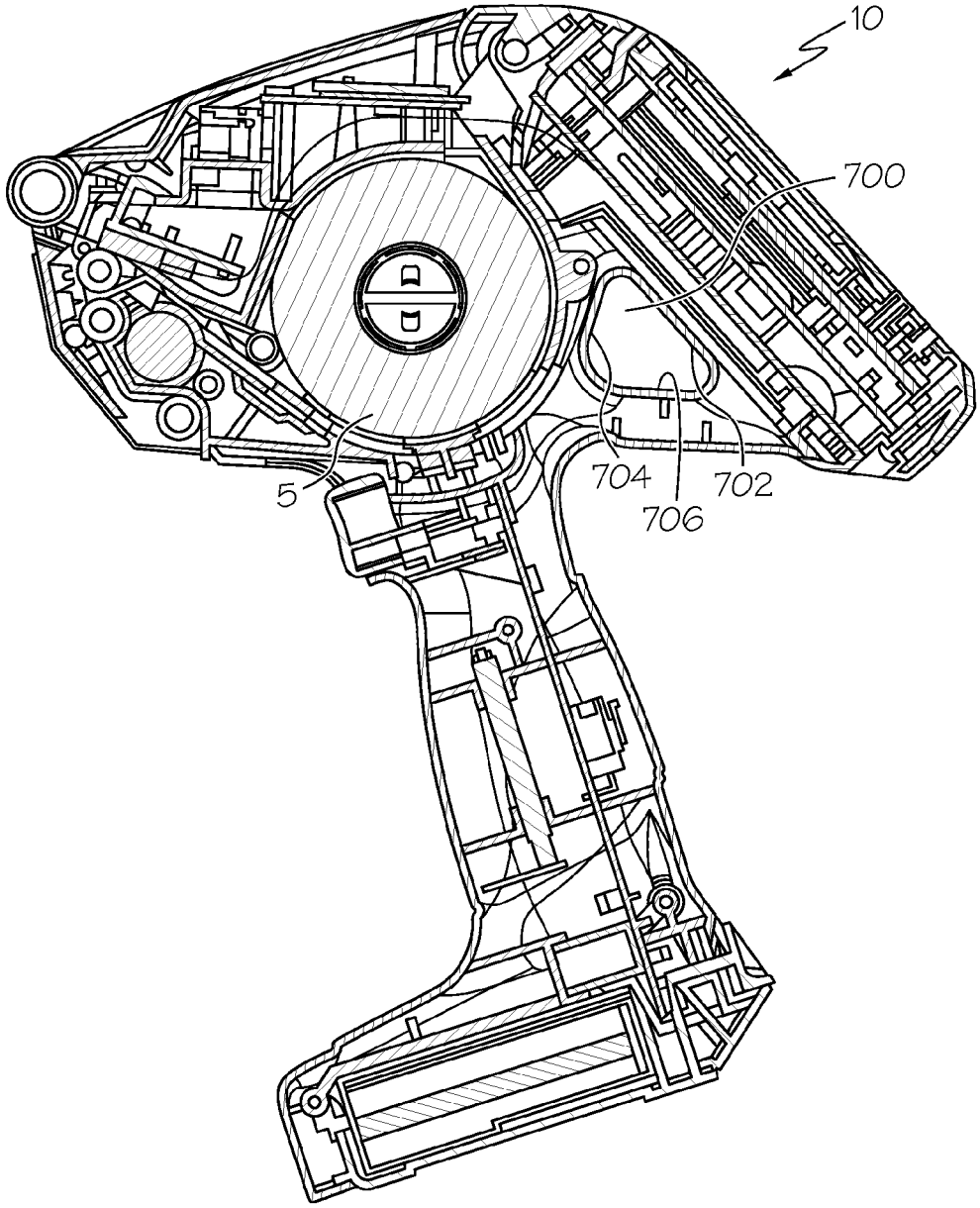
FIG. 20 is a cross sectional view taken across a plane bisecting the labeler/printer of FIG. 1.

FIG. 20 is a cross-sectional view of the labeler/printer 10 containing a roll 5 of media such as precut labels on a liner carrier member. The cross sectional view was taken along a plane extending through the center of the labeler/printer 10, and thus bisecting the labeler/printer.

Figure 21:
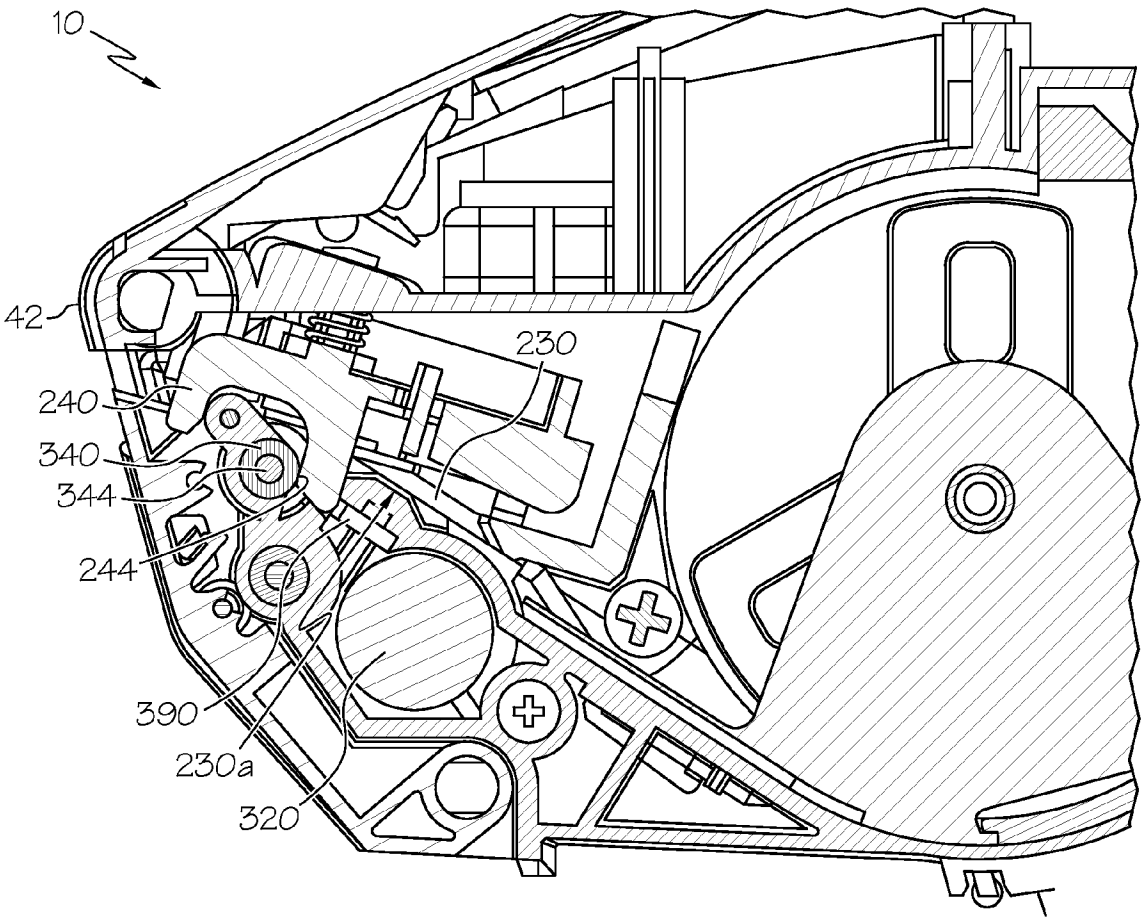
FIG. 21 is a detailed cross sectional view illustrating the front end of the labeler/printer of Figure land relative locations of components to one another.

FIG. 21 is a cross-sectional view of the labeler/printer 10 taken along a plane parallel to a bisecting plane as in FIG. 20, however spaced therefrom. The offset cross sectional view of FIG. 21 illustrates the location of the printhead mounting assembly 240 being disposed over the bearings 344 of the platen roller 340. Suitably, and as previously described, a pair of alignment surfaces 244 defined by the printhead mounting assembly 240 are located on and in contact with an outer shoulder or portion of the bearings 344 of the platen roller 340.

Figure 22:
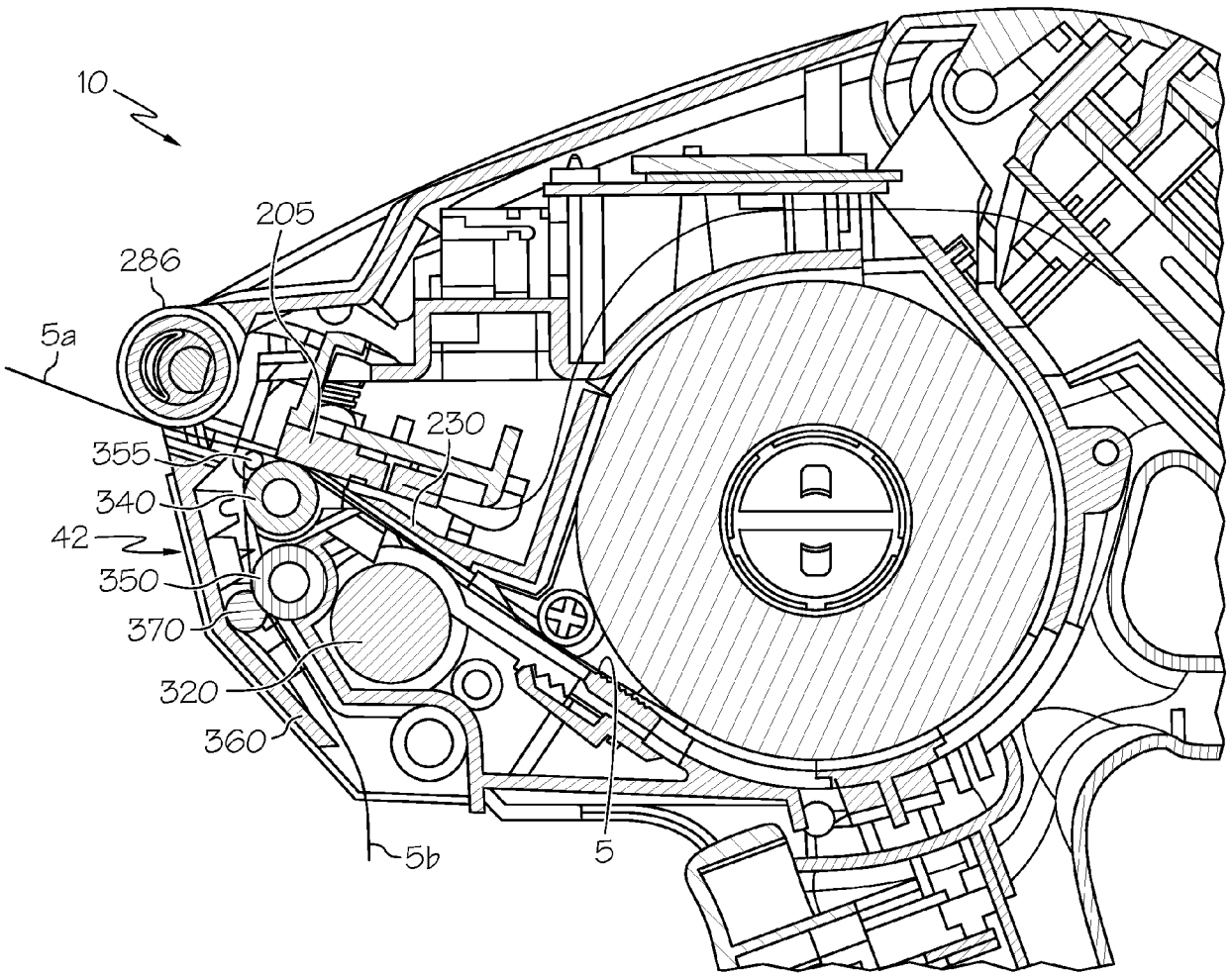
FIG. 22 is a detailed cross sectional view of the labeler/printer of FIG. 1 illustrating a paper path defined within the interior of the labeler/printer.

FIG. 22 is a detailed bisectional view, similar to that of FIG. 20 illustrating the path for paper or a roll 5 of media when used by the labeler/printer 10. The paper or media is drawn from the roll 5 from a lower region of the roll 5. The material, designated as 5, includes an upwardly directed layer 5*a* for printing and a lower liner layer 5*b*. The material 5 is pulled under and in intimate contact with the printhead 205 as a result of frictional engagement with an upwardly facing portion of the rotating platen roller 340. As will be recalled, the platen roller 340 is driven by the motor 320. As the material 5 travels past the platen roller 340 towards the front nose end 42 of the labeler/printer 10, the material passes the peel roller 355. As a result of tension applied to the liner layer 5*b* by the liner drive roller 350 and the relatively small radius of the peel roller 355, the abrupt change in direction of the liner layer 5*b* promotes separation between the layers 5*a* and 5*b*. The layer 5*a* which may for example be in the form of a label containing print on an upwardly directed face and an exposed layer of adhesive on an oppositely directed face, passes under the application roller 286 as the layer 5*a* exits the labeler/printer 10. Accordingly, a user may manipulate the labeler/printer 10, e.g., by its handle, to apply the peeled label to a desired surface and further press and/or secure the label thereto by rolling the application roller 286 over the applied label. The liner 5*b* meanwhile is gripped by and travels between the liner drive roller 350 and the pressure roller 370 as that layer then exits the labeler/printer 10 through an aperture or other opening such as provided in the deflector door 360.

Generally, the materials selected for forming the labeler/printer 10 and its various components are those providing sufficient strength and rigidity while promoting ease in manufacturing. Polymeric materials that can be injection molded are suitable for the housing and panel portions. Many of the structural components and frame members can also be formed from polymeric materials. A key consideration in material selection is dissipation of static charge build up. Thus, it is suitable for many components that the material be sufficiently electrically conducting so as to dissipate such charges to avoid detrimental charge accumulation and associated release.

For example, in one suitable embodiment, a first electrically conductive ground path is established from the printhead 205 to an electrical ground arranged on the circuit board 130. Suitably, the electrical ground may take the form of a ground plate arranged on the back side of the circuit board 130 which is unseen in FIG. 3, for example. In the illustrated embodiment, the first electrically conductive ground path includes the printhead mount assembly 240 to which the printhead 205 is mounted and the frame 270 to which the printhead mount assembly is 240 is attached. In this case, suitably the assembly 240 and frame 270 are made from electrically conductive material, e.g., such as an electrically conductive plastic. Optionally, the springs or biasing members 206 may also be metal and/or otherwise electrically conductive so as allow electrical charge to flow between the assembly 240 and the frame 270. Further, as shown, the frame includes a hub 273 that engages the post 120 about which the hub 273 rotates when the printhead module 200 is moved between its open and closed positions. Suitably, the hub 273 has an exposed exterior surface 273*a* which acts as at least part of the first electrically conductive ground path. That is to say, in practice, an electrically conductive ground contact 800 which is part of the cable assembly 148 is arranged to be relatively stationary with respect to the rotating hub 273 while otherwise continually abutting against the surface 273*a* thereof. Suitably, the contact 800 may be located behind a forward corner 186*a* of the bezel 186 and biased into contact with the surface 273*a* of the hub 273. The first electrically conductive ground path is then completed by a ground wire 802 extending from the contact 800 to a connector 149 of the cable assembly 148, which connector 149 in turn engages a corresponding connector on the circuit board 130 to complete the electrical connection with the electrical ground thereon. Notably, in this way, the first electrically conductive ground path remains unbroken regardless of the position and/or movement of the print module 200 insomuch as the contact 800 remains abutting the surface 273*a* of the hub 273 included on the electrically conductive frame 270. Moreover, it is significant that the first electrically conductive ground path does not include any flexible portions within the print module 200 that are bent when the print module 200 is moved between its closed and open positions. In this way, each time the print module 200 is opened or closed, there is no repeated flexing or bending, e.g., of a wire or other like part, which over time could lead to breaking or failure of the repeatedly flexed part.

In another suitable embodiment, a second electrically conductive ground path is also established between the trigger 26 and the electrical ground on the circuit board 130, e.g., to drain off static charge through a user touching the trigger 26 with their finger or other body part. Accordingly, the trigger 26 is optimally made of an electrically conductive material, e.g., a suitable electrically conductive plastic. Likewise, the biasing member 27 is also part of the second electrically conductive ground path. Suitably, the biasing member 27 may be the illustrated leaf spring or alternately a compression spring made from a metal or other suitable electrically conductive material. In practice, one end of the biasing member 27 contacts the trigger 26 and the other end of the biasing member may directly contact the electrical ground or ground plate on the circuit board 130 thereby pushing off from the same and biasing the trigger 26 outward or otherwise into its unactuated state.

It is also contemplated that electronic processors with associated memory provisions are utilized throughout the labeler/printer 10 and in one or more of its components to control and monitor their operation. For example, one or more of the previously described electronic circuit boards, "cards", or components, such as battery board 130, display assembly 164, keyboard assembly 178, electronic circuit board 180, print engine circuit board 184, scanner 250, mezzanine electronic circuit board 272, radio card 280, and any other components of the labeler/printer 10 can include software algorithms with updating protocols to avoid having to reboot or re-initialize the associated component(s).

Another feature of the labeler/printer 10 is the elimination of numerous intermediate components and resulting assembly simplification. This enables higher manufacturing tolerances to be achieved.

The present inventive subject matter also includes a charging cradle for the labeler/printer 10. The charging cradle can be in a variety of forms. However, one suitable form is a stationary base that slidably receives and engages the labeler/printer 10 such as along the battery enclosure 32 and in doing so, establishes electrical contact with one or more contacts such as for example electrical charging contacts 34 depicted in FIG. 19. Ports 22 may provide electronic communication with one or more components of the labeler/printer 10. The ports 22 can be in any form such as for example USB, serial, parallel, and other data and signal ports. The charging cradle is suitably provided with overcharging protection provisions, correspondingly aligned electrical contacts that establish electrical communication with the contacts 34 of the labeler/printer 10 and may include addressable operations.

Figure 23:
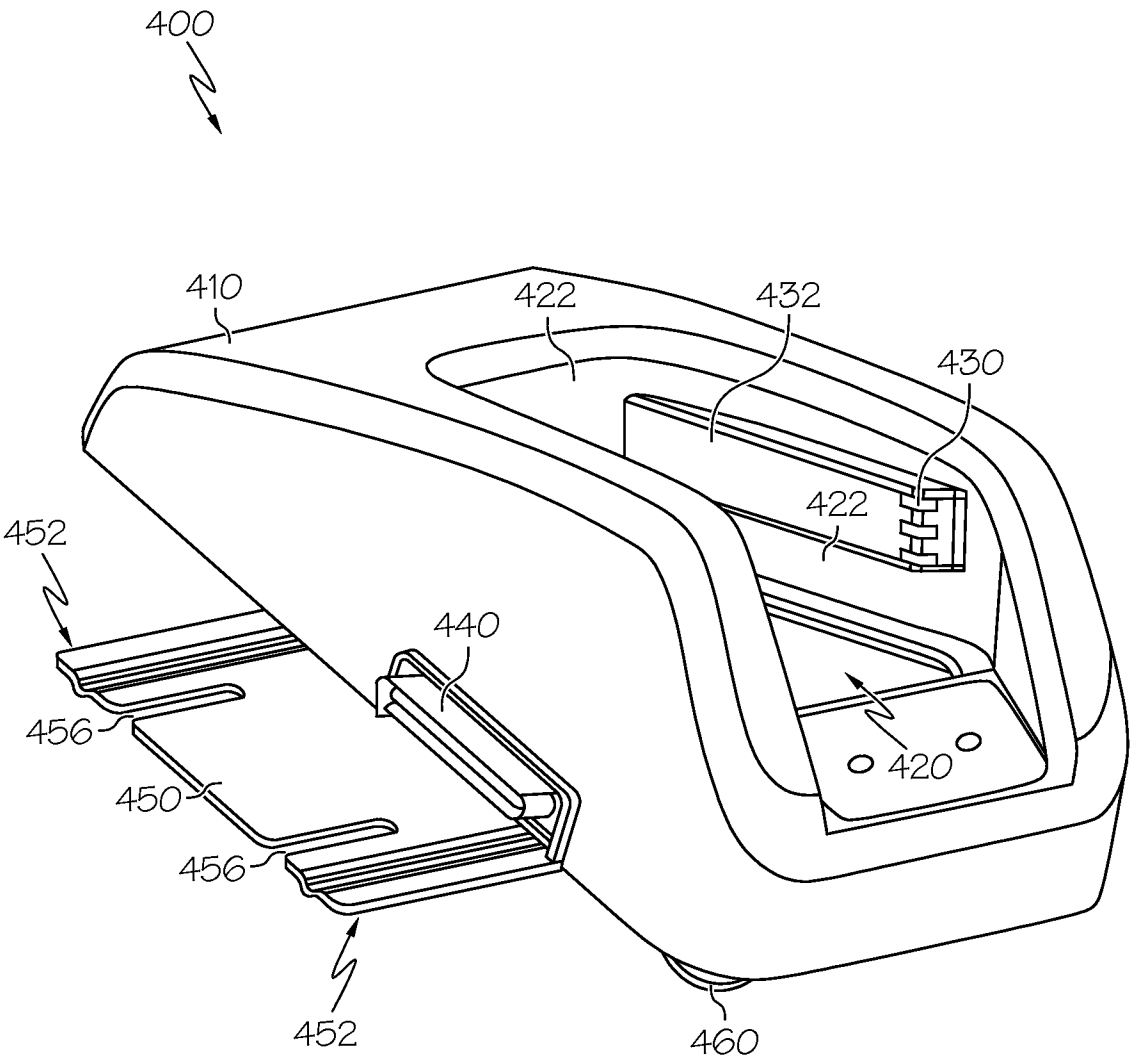
FIG. 23 is a perspective view of an exemplary embodiment of a charging cradle according to aspects of the present inventive subject matter.

FIG. 23 illustrates an exemplary embodiment of a charging cradle 400 in accordance with aspects of the present inventive subject matter. The charging cradle 400 comprises a housing 410 that defines a receiving region 420 for receiving and engaging a portion of a labeler/printer such as the labeler/printer 10. Suitably, the receiving region 420 receives a distal lowermost portion of the lower battery enclosure 32 of the labeler/printer 10, as shown in FIGS. 1 and 2. The receiving region 420 is defined by one or more interior walls 422 as shown in FIG. 23. Located along one or both of the interior walls 422 is one or more outwardly projecting guide member (s) 432 and a collection of electrical contacts 430. The guide 432 is aligned and positioned so as to be slidably received in one or more recessed regions defined along the lower battery enclosure 32 of the labeler/printer 10. The electrical contacts 430 of the charging cradle 400 are also appropriately positioned with respect to the guide 432 and the receiving region 420 of the charging cradle 400 so that upon engaging the lower battery enclosure 32 of the labeler/printer 10 with the receiving region 420 of the cradle 400, the contacts 430 are in electrical communication with one or more electrical contacts 34 located along the battery enclosure 32 of the labeler/printer 10, thus establishing electrical connection between the cradle 400 and the labeler/printer 10. The electrical contacts 430 typically serve to provide for transfer of electrical current from the cradle 400 to the labeler/printer 10 such as during charging of one or more batteries onboard the labeler/ printer 10. The electrical contacts 430 may also serve to provide signal or information transfer between the cradle 400 and the labeler/printer 10.

The charging cradle 400 also comprises one or more power and/or communication ports 440 accessible along the exterior of the housing 410. Suitably, each cradle 400 includes an outwardly extending male port, such as port 440, along one side of the housing 410 and another female port (not shown) along an oppositely directed side of the housing. This configuration enables multiple charging cradles 400 to be serially connected and/or daisy-chained to one another as described in greater detail herein.

The charging cradle 400 may also comprise an optional alignment member 450 and/or affixment base as depicted in FIG. 23. The member 450 suitably extends laterally outward from the housing 410 and serves to facilitate engagement with an adjacent component and/or promote securing the cradle 400 to an underlying support surface. One or more alignment surfaces 452 can be provided in the alignment member 450, each suitably extending from a distal end of the member 450 to the housing 410 of the cradle 400. The surfaces 452 are sized, shaped, and configured to slidably engage with corresponding receiving members provided in another component to be placed into electrical communication via the port 440. Thus, although one or more cables (not shown) can be used to connect to port 440, it is suitable to directly connect one port of a first cradle to another port of a second cradle (or other component). In this mode of connection, the alignment member 450 provides further physical engagement between the cradles and/or components. The alignment member 450 may also define one or more slotted regions 456. Instead of slotted regions, one or more apertures could be used. Regardless, the slotted regions 456 and/or other apertures can receive fastening members which may serve to affix multiple charging cradles 400 to each other or to a controller 500 or to an underlying support or surface.

Each charging cradle 400 also suitably includes a collection of feet 460 for stably supporting the cradle 400.

It will be understood that in no event is the invention limited to the particular charging cradle 400 described and illustrated in the accompanying figures. Instead, the invention includes a wide array of variant versions and designs.

Figure 24:
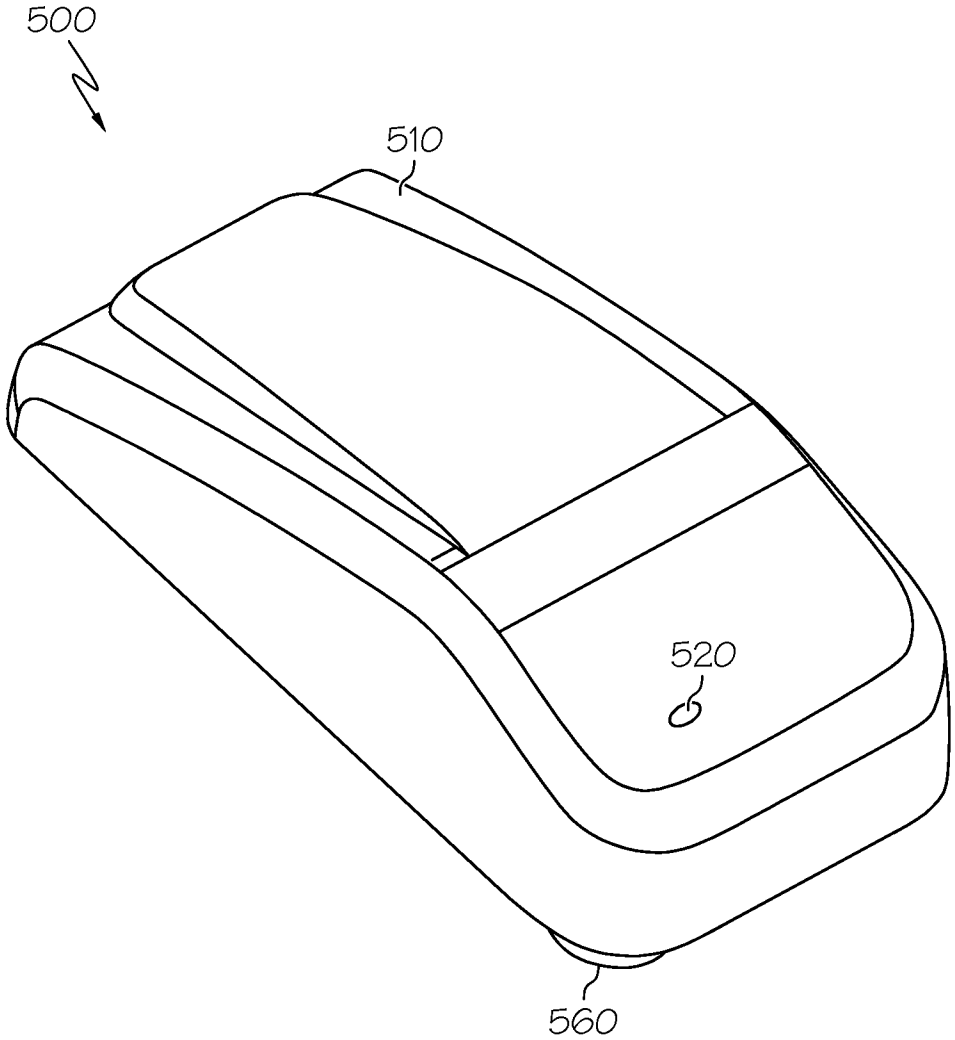
FIG. 24 is a perspective view of an exemplary embodiment of a controller for one or more of the labeler/printers/printers of Figure land one or more charging cradles or base stations as shown in FIG. 23.

FIG. 24 is a perspective view of an exemplary embodiment of a controller 500 in accordance with aspect of the present inventive subject matter. The controller comprises a housing 510, one or more indicator lights 520, and one or more feet 560 as generally depicted in FIG. 24. The controller also comprises various electronic processors and memory provisions and is configured to at least partially control the operation and charging of the labeler/printer 10, and suitably also at least partially control the operation and charging of the cradle 400. Furthermore, the controller 500 can also be configured to assist in the programming and transfer of operation instructions and other information between the labeler/printer 10, the cradle 400, and the controller 500.

Figure 25:
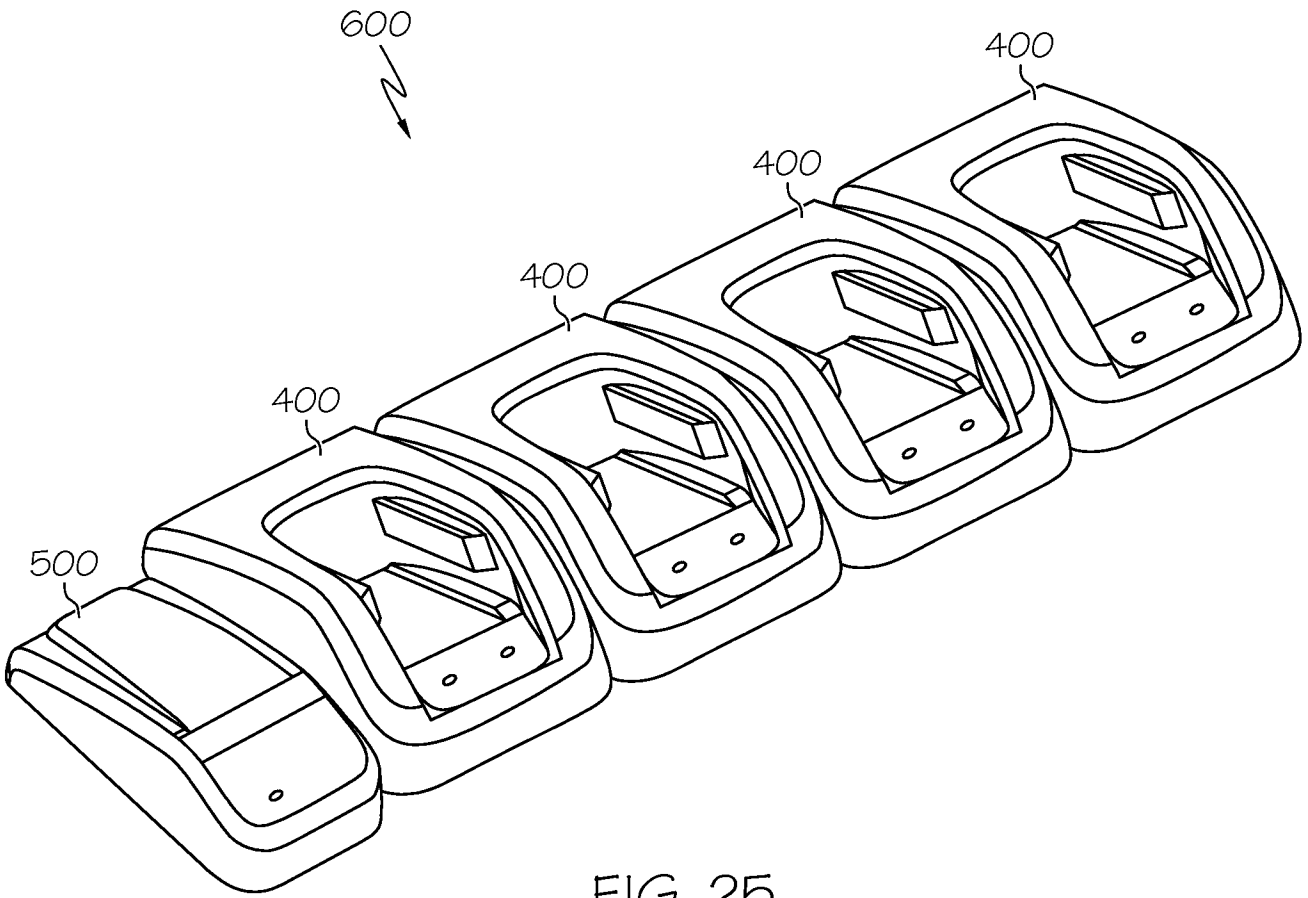
FIG. 25 is a front perspective view of a collection of charging cradles and a controller in communication with one another in accordance with aspects of the present inventive subject matter.
Figure 26:
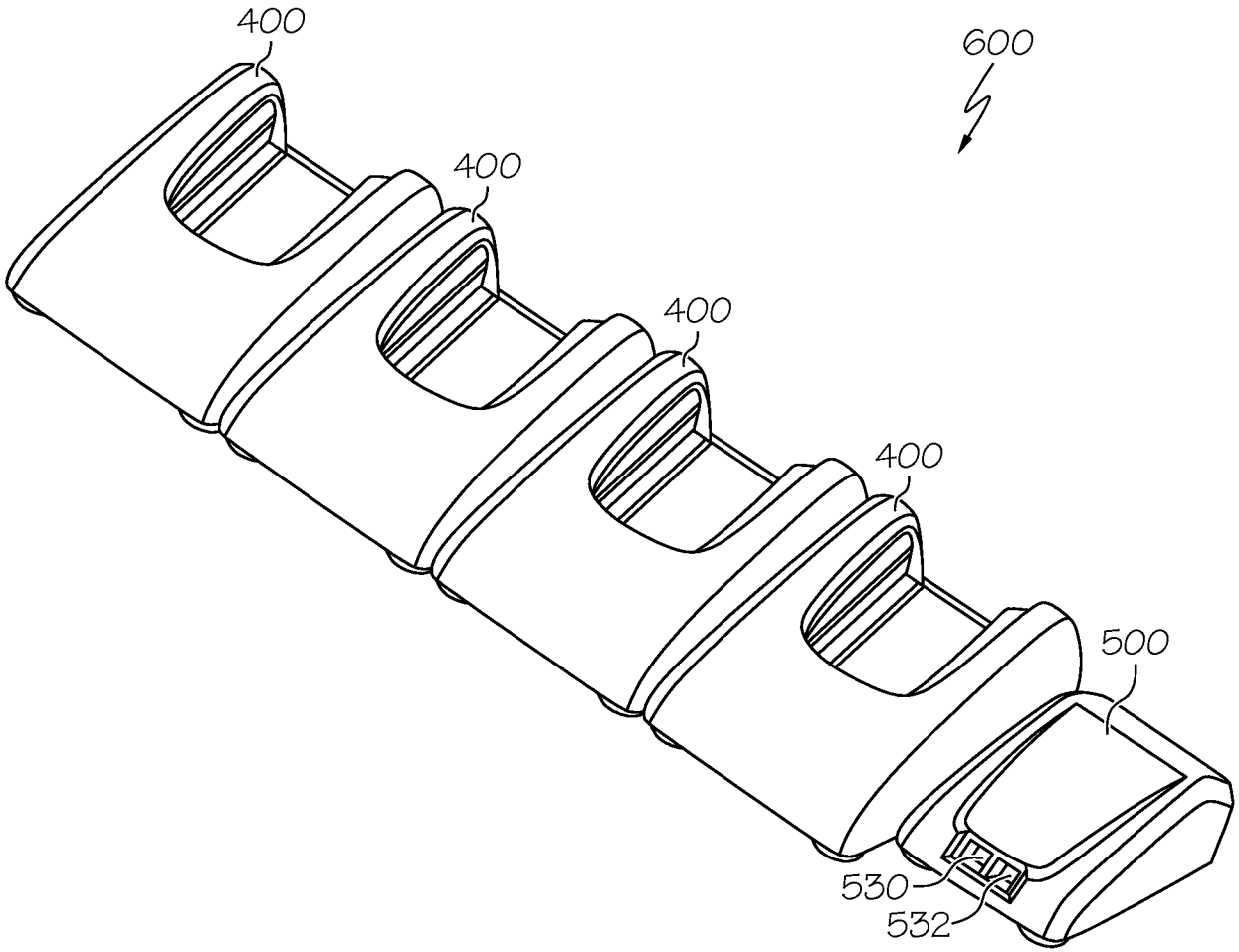
FIG. 26 is a rear perspective view of the collection of the exemplary controller and charging cradles depicted in FIG. 25.

FIGS. 25 and 26 illustrate a combination 600 of one or more charging cradles 400 and a controller 500 in accordance with aspects of the present inventive subject matter. These figures are merely one possible configuration of a plurality of charging cradles 400, each in electrical communication with one another via their corresponding ports (such as port 440 depicted in FIG. 23) and also in electrical communication with a controller 500. The controller 500 receives electrical power from a power cord (not shown) via a port 530 shown in FIG. 26. One or more accessory ports 532 may also be provided for signal or information transfer to or from the controller 500. Suitably, each charging cradle 400 has a unique electronic address whereby the controller 500 controls the transfer of electrical power to each cradle 400 by appropriately selecting the cradle 400 via its address. Furthermore, one or more cradles 400 can be selected by the controller 500 to receive particular information, signals, and/or programming for the respective cradles and/or its corresponding labeler/printer engaged therein.

Another feature of the combination or system 600 of one or more cradles 400 and the controller 500 is that the controller 500 may also be configured to selectively and wirelessly communicate, e.g. transfer signals and/or information, with one or a collection of labeler/printers. For example, a controller 500 may wirelessly provide information to onboard memory provisions in one or more labeler/printers.

Yet another significant feature of the labeler/printer 10 is that the center of mass, and configuration and orientation of the lower face of the battery enclosure 32 are such that the labeler/printer 10 can be placed in an upright "standing" position in which the lower face of the battery enclosure 32 contacts a support surface. The center of mass is located over the lower face and relatively low such that the labeler/printer 10, when placed in such position, is remarkably stable.

A further feature of the labeler/printer 10 is the provision of a smaller diameter or thickness grip in the location of the handle 24. This improves user feel and workability, particularly for users having relatively small hands.

Additional details and aspects of hand-held labelers, printers, and related systems are set forth in one or more of the following patent documents owned by the assignee of the present application: U.S. Pat. Nos. 6,619,204; 6,652,170; 6,712,112; 7,073,717; 7,170,538; 7,180,627; 7,367,372; D631,087; and U.S. Patent Publication No. 2010/0103238.

Many other benefits will no doubt become apparent from future application and development of this technology.

All patents, applications, and articles noted herein are hereby incorporated by reference in their entirety.

It will be understood that any one or more feature or component of one embodiment described herein can be combined with one or more other features or components of another embodiment. Thus, the present invention includes any and all combinations of components or features of the embodiments described herein.

As described hereinabove, the present invention solves many problems associated with previous type devices. However, it will be appreciated that various changes in the details, materials and arrangements of parts, which have been herein described and illustrated in order to explain the nature of the invention, may be made by those skilled in the art without departing from the principle and scope of the invention, as expressed in the appended claims.

What is claimed is:

1. A hand-held portable printer comprising:

a housing having a main body and a handle extending therefrom;

a rotatably driven platen roller supported in the main body of the housing;

a supply roll holder that holds a supply roll of media in the main body of the housing;

a circuit board including an electrical ground;

a print module including a printhead that selectively prints on media routed between the printhead and the platen roller from the supply roll held by the supply roll holder, said print module being attached to the upper main body of the housing such that the print module is movable between a closed operational position in which the printhead is proximate the platen roller and an open loading position in which the printhead is spaced apart from the platen roller; and a first electrically conductive ground path extending from the printhead to the electrical ground on the circuit board, said circuit board being housed outside the movable print module and housed within the handle of the housing, and said first electrically conductive ground path remaining unbroken regardless of the position of the print module.

2. The printer according to claim 1, wherein at least a portion of the first electrically conductive ground path comprises:

a printhead mount to which the printhead is mounted.

3. The printer according to claim 2, wherein at least a portion of the first electrically conductive ground path comprises:

a frame to which the printhead is mounted is attached.

4. The printer according to claim 3, wherein at least one of the frame and the printhead mount is made from an electrically conductive plastic.

5. The printer according to claim 3, wherein said frame includes a hub that engages a post about which said hub rotates when the printhead module is moved between its open and closed positions, said hub having a surface which is at least part of the first electrically conductive ground path.

6. The printer according to claim 5, wherein said first electrically conductive ground path further comprises:

at least one contact which is substantially stationary with respect to said hub, said contact abutting the surface of the hub as it is rotated.

7. The printer according to claim 6, wherein said first electrically conductive ground path further comprises:

at least one ground wire which extends from the contact to the circuit board.

8. A hand-held portable printer comprising:

a housing having a main body and a handle extending therefrom;

a rotatably driven platen roller supported in the main body of the housing;

a supply roll holder that holds a supply roll of media in the main body of the housing;

a circuit board including an electrical ground;

a print module including a printhead that selectively prints on media routed between the printhead and the platen roller from the supply roll held by the supply roll holder, said print module being attached to the upper main body of the housing such that the print module is movable between a closed operational position in which the printhead is proximate the platen roller and an open loading position in which the printhead is spaced apart from the platen roller;

a first electrically conductive ground path extending from the printhead to the electrical ground on the circuit board, said circuit board being housed outside the movable print module, and said first electrically conductive ground path remaining unbroken regardless of the position of the print module; and wherein the first electrically conductive ground path does not include any flexible portion within the print module that is bent when the print module is moved between its closed and open positions.

9. A hand-held portable printer comprising:

a housing having a main body and a handle extending therefrom;

a rotatably driven platen roller supported in the main body of the housing;

a supply roll holder that holds a supply roll of media in the main body of the housing;

a circuit board including an electrical ground;

a print module including a printhead that selectively prints on media routed between the printhead and the platen roller from the supply roll held by the supply roll holder, said print module being attached to the upper main body of the housing such that the print module is movable between a closed operational position in which the printhead is proximate the platen roller and an open loading position in which the printhead is spaced apart from the platen roller;

a first electrically conductive ground path extending from the printhead to the electrical ground on the circuit board;

a trigger that is manually actuated by a user to control an operation of the printer; and a second electrically conductive ground path extending from the trigger to the electrical ground on the circuit board.

10. The printer according to claim 9, wherein the second electrically conductive ground path includes a biasing member that biases the trigger towards an unactuated state.

11. The printer according to claim 10, wherein the biasing member is one of a leaf spring or a compression spring.

12. The printer according to claim 10, wherein said electrical ground is a ground plate and at least one end of the biasing member directly contacts the ground plate.

13. The printer according to claim 9, wherein the trigger is made from an electrically conductive plastic.

* * * * *